United States Patent [19]

Zak

[11] Patent Number: 4,715,846

[45] Date of Patent: Dec. 29, 1987

[54] TRAILING PANEL FOLDER

[75] Inventor: Chet Zak, West Newbury, Mass.

[73] Assignee: Post Machinery, Inc., Portsmouth, N.H.

[21] Appl. No.: 872,797

[22] Filed: Jun. 11, 1986

[51] Int. Cl.[4] ..... B31B 1/00

[52] U.S. Cl. ..... 493/10; 493/177; 493/425; 493/453

[58] Field of Search ..... 493/1, 2, 8, 10, 23, 493/127, 166, 177, 182, 425, 453, 454

[56] References Cited

U.S. PATENT DOCUMENTS

| | | | |
|---|---|---|---|
| 3,330,185 | 7/1967 | Annet et al. | 493/425 |
| 3,901,134 | 8/1975 | Reizenstein et al. | 493/10 |
| 4,119,018 | 10/1978 | Nava | 493/10 |
| 4,432,745 | 2/1984 | Eldridge | 493/10 |
| 4,539,002 | 9/1985 | Zak | 493/23 |

*Primary Examiner*—Frederick R. Schmidt
*Assistant Examiner*—Robert Showalter
*Attorney, Agent, or Firm*—Fitch, Even, Tabin & Flannery

[57] ABSTRACT

A trailing panel folding system for use in a blank folding machine. The system includes a rotatable shaft mounted below the pass path of the blanks and transverse thereto. A motor is connected to drive this shaft and an arm assembly is mounted on the shaft and includes an arm extending away from the shaft and a folding head for folding a trailing panel of a blank. An encoder is interconnected with the drive means to provide a pulsed output related to the velocity at which the blanks are moving along the path, and a blank sensor provides a trailing edge signal when the trailing edge of the sensed blank leaves the location. A programmable motor controller moves the arm assembly to a predetermined start position in which the folding head is disposed upstream of the shaft, causes the folding head to move to an up position wherein it overlies the folded trailing panel at a speed sufficiently fast to overtake and fold the panel, causes the folding head to dwell in the up position, and causes the arm means to move to a start position after the folded panel has moved from under the folding head. A method of folding a trailing panel of a carton blank is also disclosed.

11 Claims, 11 Drawing Figures

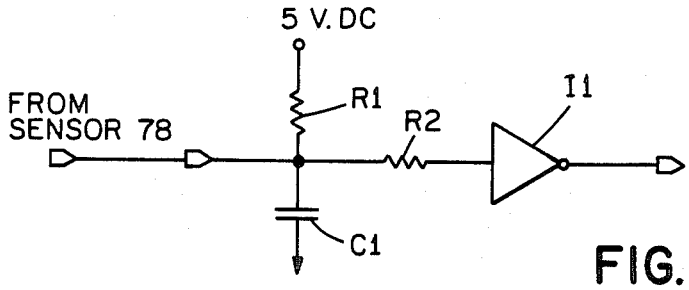
FIG. 7
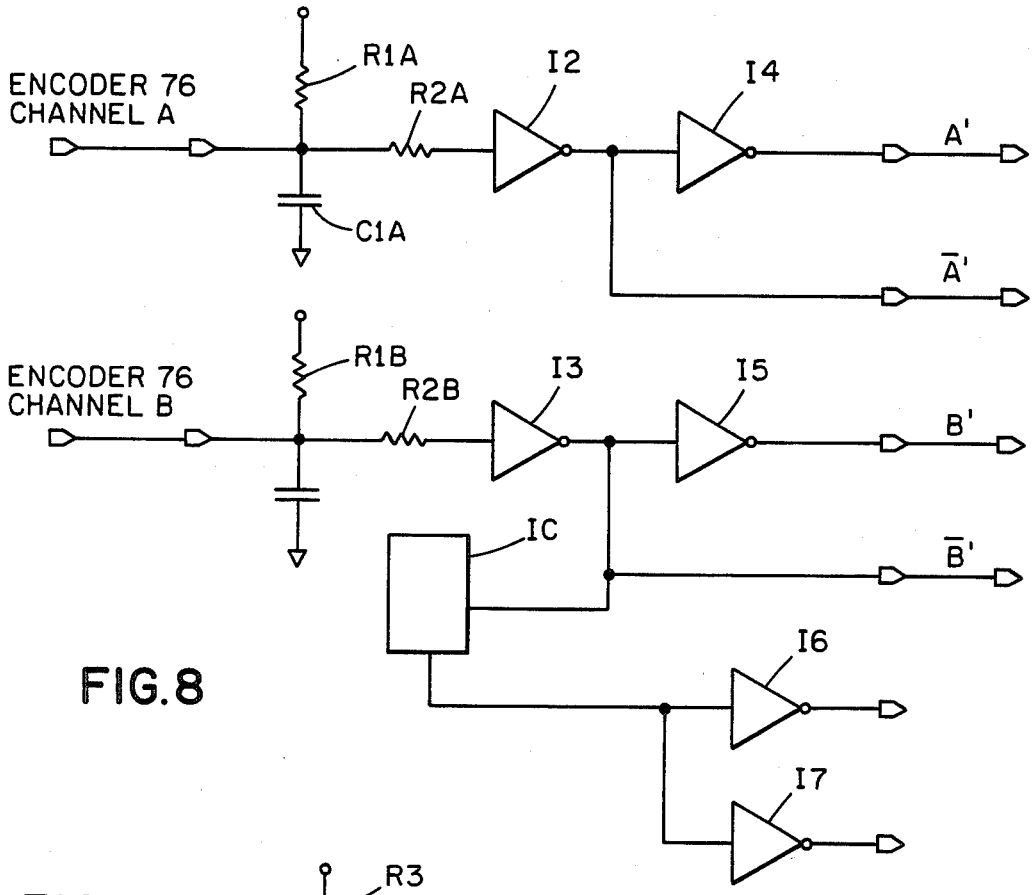
FIG. 8
FIG. 9
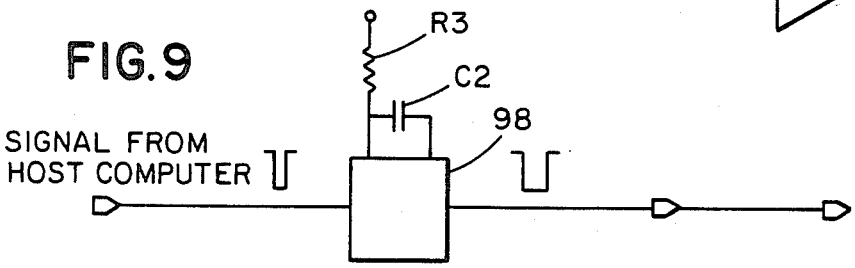
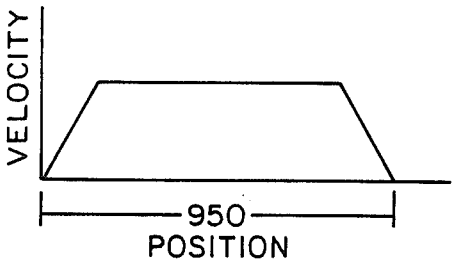
FIG. 10
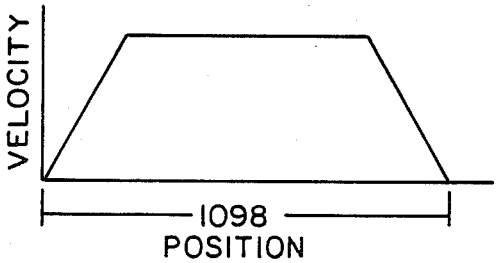
FIG. 11

TRAILING PANEL FOLDER

The present invention relates to apparatus for folding carton blanks and, more particularly, to a trailing panel folding system for use in a blank folding machine and, still more specifically, to such a system including a motor controlled by a microprocessor.

BACKGROUND OF THE INVENTION

In processing lines where carton blanks are conveyed along a straight line path for folding and gluing, it is relatively straightforward to engage the leading and lateral edge panels or flaps with plows or shoes or the like and fold them into position for gluing. The trailing panels or flaps of carton blanks are more difficult to engage and fold because the blanks are moving in the direction of the fold and hence away from any folding mechansim. A trailing edge folder for operating with a mechanically timed feed which employs a shaft that is intermittently rotated in conjunction with the timed carton feed is shown in U.S. Pat. No. 3,330,185.

Another device for folding the trailing edges of carton blanks is described in U.S. Pat. No. 3,901,134. An endless loop having a run below the carton blank conveyor is intermittently operative and carries pivotal folding fingers that are biased to a rest position and pivoted by various cams as the finger is carried below the carton blank to engage and fold its trailing end flap. While the mechanism is adjustable to accommodate blanks of various sizes and does not require a mechanically timed feed, its speed in handling small carton blanks is limited by the speed at which successive fingers are carried onto the upper run of the loop, and smaller boxes or cartons may have to be spaced at substantial intervals from each other thereby reducing the efficiency of the apparatus. Additionally, this mechanism, which includes a chain drive, requires a great deal of maintenance, is subject to fast wearing of components, and thus presents significant operational difficulties. Although the speed of the fingers might be adjusted by changing the geometry of the fingers and loop, such changes are cumbersome and such apparatus is generally operated at a constant speed.

A more recent trailing edge folder and controller are shown in commonly-assigned U.S. Pat. Nos. 4,432,745 and 4,539,002, the respective teachings of which are hereby incorporated herein by reference. This trailing edge folder includes an intermittently rotatable shaft mounted below and transverse to the horizontal path of the carton blanks. The shaft includes an arm or arms that extend generally radially from the shaft. The arms have folding heads at their distal ends for contacting and folding the trailing panels of successive blanks along fold lines parallel to the respective trailing edges. The shaft stops and dwells when a respective trailing edge is folded about 180° on the fold line. After the panel is pulled from under a head and the blank is out of the path of the head, the shaft rotates further to a start position until the next blank appears along the path.

More specifically, this trailing edge folder is powered by the main drive of the blank folding machine of which the folder is an accessory. The shaft is connected to a main drive power takeoff using a clutch/brake mechanism. While this trailing edge folder operates satisfactorily, the need continues for improved folders offering greater accuracy, longer life, quieter operation and greater production rates. As the folder shaft is connected to the machine main drive, vibrations occasioned by starting and stopping of the folder shaft are reflected back into the main machine drive. This arrangement also requires that the folder shaft have the same angular velocity throughout its cycle of operation.

SUMMARY OF THE INVENTION

Among the several aspects and features of the present invention may be noted the provision of an improved trailing panel folding system. The improved system includes one of more separate shafts carrying the trailing panel folding arms which shafts are each driven by a separate motor not part of the main machine drive system. Vibrations occasioned by the starting and stopping of these shafts are therefore not reflected into the main drive system resulting in quieter and smoother operation of the main drive system. The folder system motor has a rotor the position of which is precisely controlled by means of a programmable motor controller. Additionally, the controller operates the motor to run at different angular velocities during different portions of its cycle. The minimum spacing between blanks is reduced by increasing the speed at which the folder arm returns to a start position from its dwell position. Thus, the folding system of this present invention results in an increase in the production rate of the blank folding machine. The folder system of the present invention is reliable in use, has long service life and is relatively easy to manufacture using many commercially available components. Other aspects and features of the present invention will be, in part, apparent and, in part, pointed out hereinafter in the specification and accompanying drawings.

A trailing panel folding system embodying various aspects of the present invention includes a motor, which is not part of the main drive means of the blank folding machine, connected to drive a rotatable shaft mounted below the pass path of the carton blanks and transversely thereto. Mounted on the shaft is an arm assembly having at least one arm extending from the shaft with a folding head for folding a trailing panel at the free end of the arm and projecting therefrom generally normal to the axis of the shaft. An encoder interconnected with the main drive means provides a pulsed output related to the velocity at which the blanks are moving along the path, and a blank sensor is positioned upstream of the shaft to signal passage of a carton blank. The motor is operated through a cycle of operations by a programmable motor controller which moves the arm to a predetermined start position wherein the folding head is upstream of the shaft, causes the head to move to an up position wherein it overlies the folded trailing panel at a speed sufficiently fast to overtake and fold the panel, causes the folding head to dwell in the up position, and causes the arm assembly to move to a start position after the folded panel has moved from under the folding head. A microprocessor which is interconnected with the encoder, blank sensor and the controller receives input signals based upon the operation of the sensor and the encoder and provides output signals to the controller to start the cycle of operation and to cause the head to move from the up position.

As a method of folding trailing panels, the present invention includes the following steps:

(a) the folding head is positioned in a start position below the pass path of the carton;

(b) the passage of a carton blank is detected upstream of the shaft;

(c) after expiration of a delay period after the detection, the folding head is accelerated to a first maximum angular velocity to move the folding head toward its up position resulting in the trailing panel being folded;

(d) the head is maintained in this up position until the folded panel is advanced from underneath the head; and (e) the head is returned to a start position in which it is positioned below the pass path of the carton blanks by accelerating a head to a maximum angular velocity greater than the aforementioned angular velocity.

BRIEF DESCRIPTION OF THE DRAWINGS

FIG. 7 is a schematic diagram of a signal conditioning circuit for use with one of the sensors;

FIG. 8 is a schematic diagram of a signal conditioning circuit for use with the encoder;

FIG. 9 is a schematic diagram of a signal conditioning circuit for providing a conditioned input to one of the programmable motor controllers;

FIG. 10 is an example of a velocity/acceleration profile according to which a motor could be controlled to move a folder head from a start position to a fold or up position in which the head dwells; and FIG. 11 is an example of a different velocity/acceleration profile according to which the motor could be controlled in returning the folding head from its up position to a start position.

Corresponding reference characters indicate corresponding components throughout the several drawings.

BRIEF DESCRIPTION OF THE SOFTWARE

A program is included of the contents of a memory associated with the host computer.

DESCRIPTION OF THE PREFERRED EMBODIMENT

Figure 1:
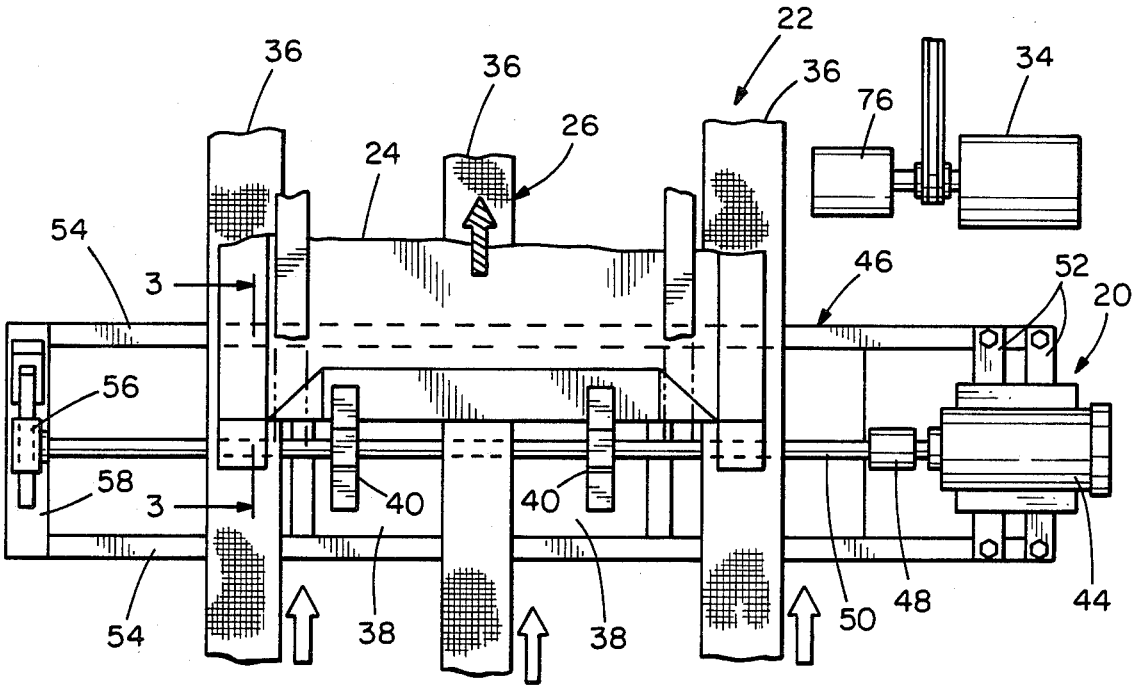
FIG. 1 is a plan view of a portion of a blank folding machine including a trailing panel folding system embodying various features of the present invention.
Figure 2:
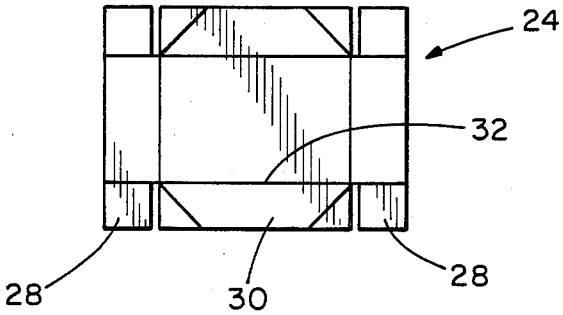
FIG. 2 is a plan view of a carton blank.

Referring now to FIG. 1, a trailing panel folding system 20 embodying various features of the present invention is illustrated used in a machine 22 (a small portion of which is shown) for folding and gluing carton blanks 24. The carton blanks are supported and continuously advanced in untimed relationship by a conveyor 26 in a predetermined direction (shown by the arrows in FIG. 1) along a generally horizontal path. The carton blank 24 illustrated in FIG. 2 includes a pair of outer trailing panels 28 flanking an inner trailing panel 30 all three of which are to be folded about a fold line 32.

Figure 3:
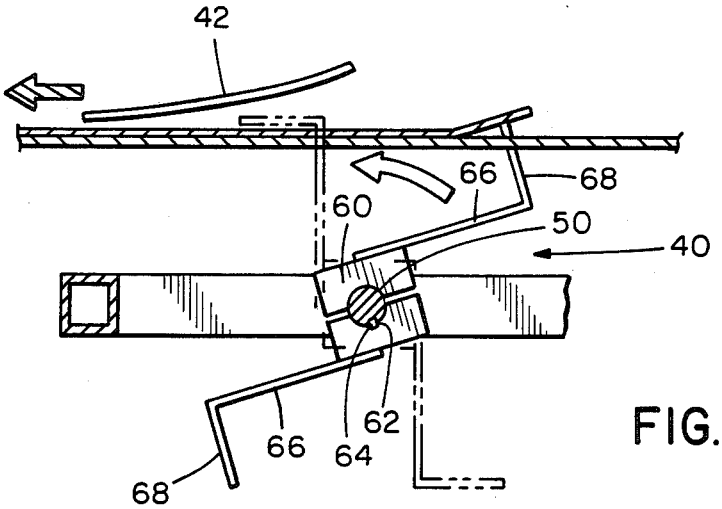
FIG. 3 is a sectional view taken generally along line 3—3 of FIG. 1.

The conveyor 26 is driven by a main drive 34 and the portion of the conveyor illustrated includes a trio of spaced parallel lower belts 36 providing two open regions 38. Folding arm means 40 of the folding system 20 are positioned in alignment with these openings and function to fold the inner trailing panel 30 substantially 180 degrees about fold line 32. The lower belts may be 1 to 2 inches wide and they are laterally adjustable to locate them relative to the shape and size of the carton blanks being handled. This portion of the conveyor also includes a pair of outside belts (not shown) which do not overlie the inner trailing panel 30 and cooperate with the outer lower belts to advance the blanks. It is noted that only one folding station (a "B" station) of the system 20 is shown in FIG. 1. The outer trailing panels 28 are folded in a different section of the machine 22 at a different folding station (the "A" station) of the system 20 where the various belts of the conveyor are positioned so as not to interfere with panels 28 and another set of folding arm means 40 is provided for those panels. As shown in FIG. 3, once folded the trailing panel is folded, it is maintained folded due to the presence of an overlying stationary skid 42 under which the panel is advanced.

As both folding stations of the system 20 have substantially identical components, only those components at one station need be described in detail. The trailing panel folding system 20 includes a motor 44, which is not part of the main drive system 34, mounted on the frame 46 of the machine 22. The rotor of the motor is connected by a coupling 48 to rotate a shaft 50 extending below and across the horizontal path of the carton blanks. More specifically, the motor 44 can be mounted at one side of the frame on transverse members 54 joined by cross pieces 52, with the remote shaft end journaled for rotation within a pillow block 56 mounted on cross piece 58 connecting the transverse members 54 at the other side of the frame.

Figure 4:
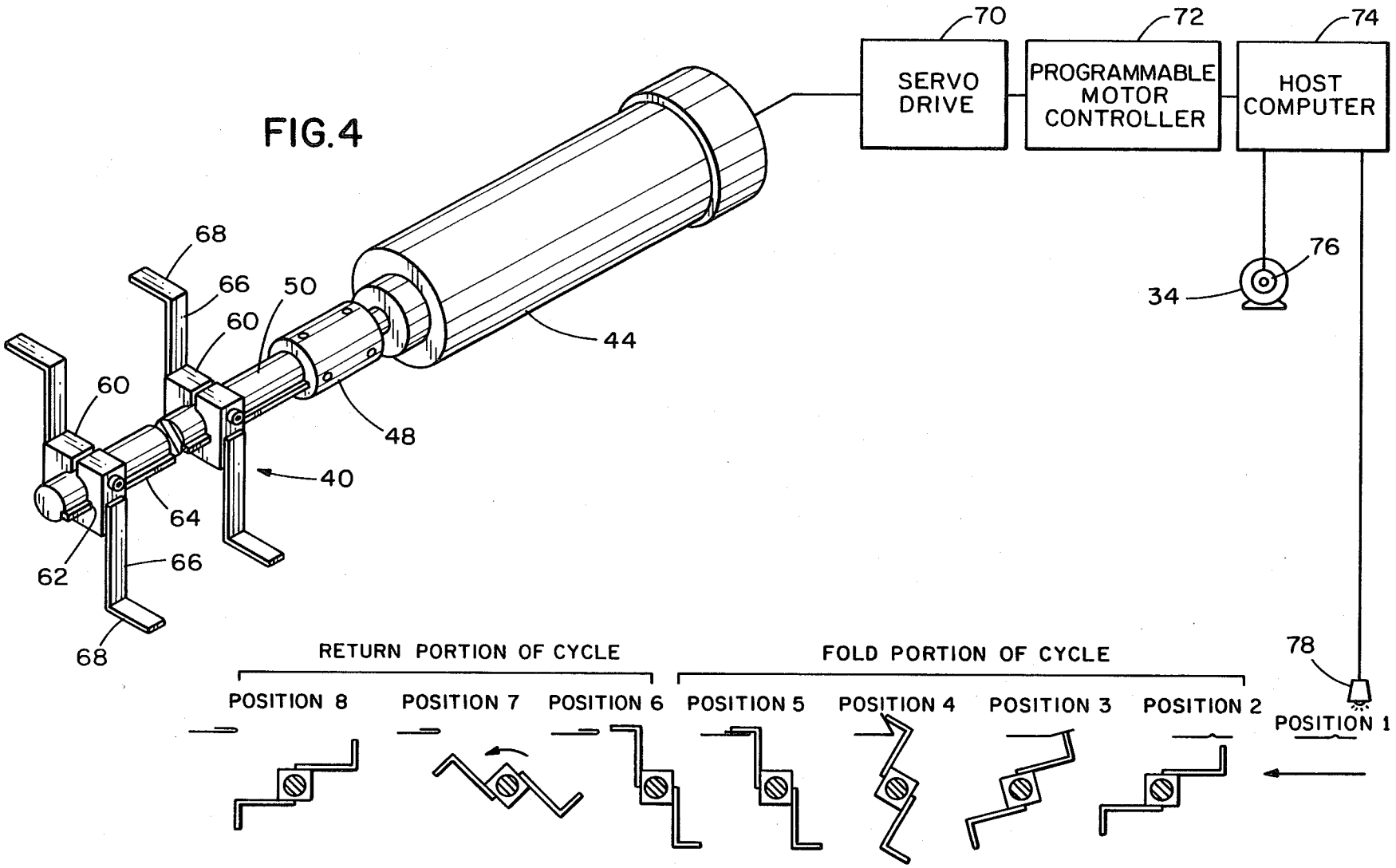
FIG. 4 is a illustration of the trailing panel folding system of FIG. 1 including a motor shown in perspective, various major components for controlling the motor being shown in block form, and a schematic diagram depicting the several orientations of a rotatable shaft connected to the motor to show one cycle of operation of the folding system.

As best shown in FIGS. 3 and 4, the folding arm means 40 is mounted for rotation on the shaft 50 and includes a pair of spaced-apart assemblies. Each assembly includes a split block 60 one of the halves of which has a keyway 62 receiving a key 64 carried in a groove in the shaft 50. These blocks can be repositioned as required along the length of the shaft by loosening the fasteners joining the blocks. Extending from each block half generally radially from the shaft 50 is a spacer arm 66 carrying at its distal end a folder head 68 which extends substantially normal to the axis of the shaft 50. The free ends of the heads 68 of one assembly are spaced by 180 degrees with respect to the axis.

As shown in FIG. 4, each motor 44 is preferably a synchronous brushless servomotor having a servo drive 70. Such a motor and drive are Model 310 and Model BDS3, respectively, sold by Kollmorgen of Radford, Va. Each servo drive 70 is controlled by a programmable motor controller 72 which determines the acceleration/velocity profiles (examples of which are shown in FIGS. 10 and 11) for various portions of the cycle of operation of the motor (which is through a 180 degree rotation of the shaft 50) as will be discussed more fully hereinafter. Such a programmable motor controller is available from Ormec Systems Corp. The operations of the two programmable motor controllers are in turn controlled by a host computer 74 which receives inputs regarding the speed of the conveyor 26, when a carton blank 24 is detected at a predetermined location upstream of a folding station and the length of the blanks.

Associated with the host computer 74 is a memory which includes a "look up" table. The table contains delay information to compensate for the fixed response time of the motor 44 and shaft 50 with varying velocities of the conveyor 26. An example of such a host computer is the Model 7806 Z80A multifunction central processing unit (CPU) card with an associated Model 7606 parallel input/output (I/O) card both available from PRO-LOG Corporation, Monterey, Calif.

The speed of the conveyor is provided by a shaft encoder 76 mounted in operative relationship with the machine main drive 34. The encoder 76 generates incremental pulses representing the angular velocity of the main drive shaft and is therefore related to the speed of carton blank travel. As will be discussed more fully hereafter, various signal conditioning circuitry and multipliers are used so that, for example, a 160 kHz host computer input can indicate a carton blank velocity of 500 ft./min. An example of such an encoder is part No. MD25-SB0-2000-5SEFAS-10S from Motion Control Devices, Lowell, Mass.

The carton blanks 24 are sensed a predetermined distance upstream of each trailing panel folding station by a photoelectric sensor 78. The sensor can be a background suppression scanner which functions to detect the presence of objects at only a predetermined range of distances from scanner. This range includes the pass path of the blanks. This scanner ignores object movement beyond the range and also short of the range. Thus the presence of dust on the scanner lenses does not effect its operation. An example of such a scanner is model F4A-04 by Data Logic.

The operator supplies the indication of carton trailing panel length by setting switches 80. Two switches are provided because the lengths of the outer trailing panels 28 could be different than the length of the inner trailing panel 30 or because it might be desired for the inner trailing panel to be contacted at a different location than the outer trailing panels. Although the switches may provide an analog display, they provide a binary coded signal for the host computer 74.

The general operation of the trailing panel folding system 20 is shown in the schematic in FIG. 4 depicting various positions of the carton length. In position 1, the trailing edge of the panel 30 is detected by the sensor 78. This information is provided to the host computer 74 which after the expiration of a delay based upon the information in the look-up table and the setting of the appropriate carton length switch 80, provides a "start" signal to the programmable motor controller 72 which, when the trailing edge reaches position 2 causes the motor 44 to accelerate to a predetermined velocity according to a programmed acceleration/velocity profile causing progressive folding of the trailing edge as shown in positions 3 and 4. Upon the folding head 68 reaching the overlying generally horizontal position shown in FIG. 5, the programmable motor controller 72 causes the motor to dwell until such time as the folded panel 30 is advanced out from under the folding head 68. At this time the host computer 74 is programmed, based on the speed of the carton blank travel, to provide a "recover" signal to the programmable motor controller 72 causing the motor 44 to operate according to a different acceleration/velocity profile to return it to a start position, shown in position 8 where the shaft has rotated 180 degrees.

It is noted that the acceleration/velocity profile for returning the head to a start position from the up position may cause a greater angular velocity of the shaft than in the starting to up position. This fast return allows closer spacing of cartons thereby increasing the production rate. For example, with a uniform maximum angular velocity throughout the entire 180 degrees of operation, the minimum space in between cartons might be 13½". However with the greater velocity during the return portion of the cycle of operation the minimum carton spacing might be able to be reduced to 10½". In the event that extremely long carton blanks are being folded, the maximum angular velocity during the return portion of the cycle might be slower than the velocity used to move the folding head to its up position. In this situation, cooling is enhanced because less current is required to move the motor at the lower return velocity. The ability to vary the angular velocity also offers an advantage in that the initial contact point of the folder head on the panel to be folded can be varied for optimal performance.

Figure 5:
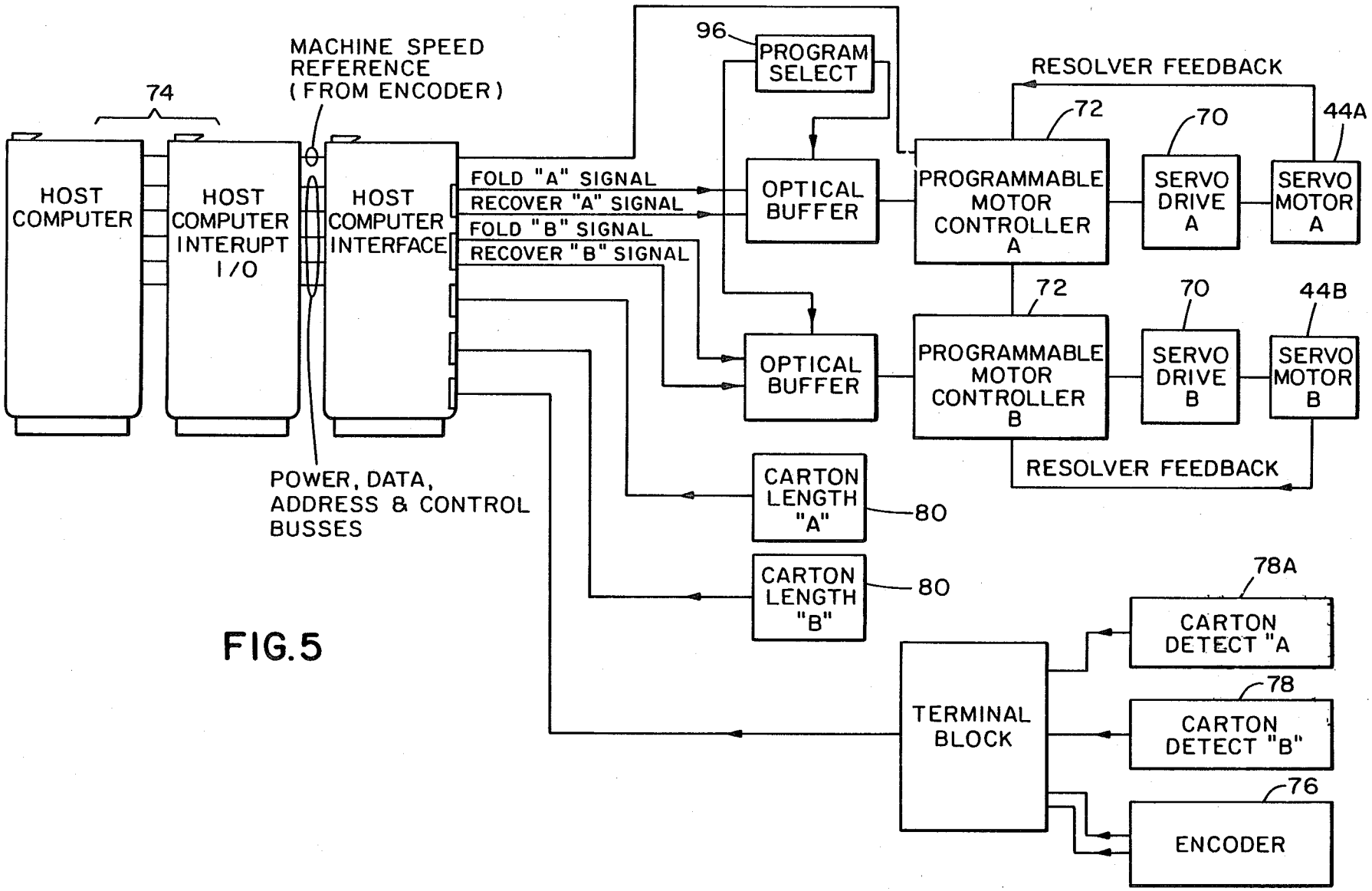
FIG. 5 is a block diagram illustrating certain components (including carton blank sensors, an encoder, and programmable motor controllers) of the system of FIG. 4.
Figure 6:
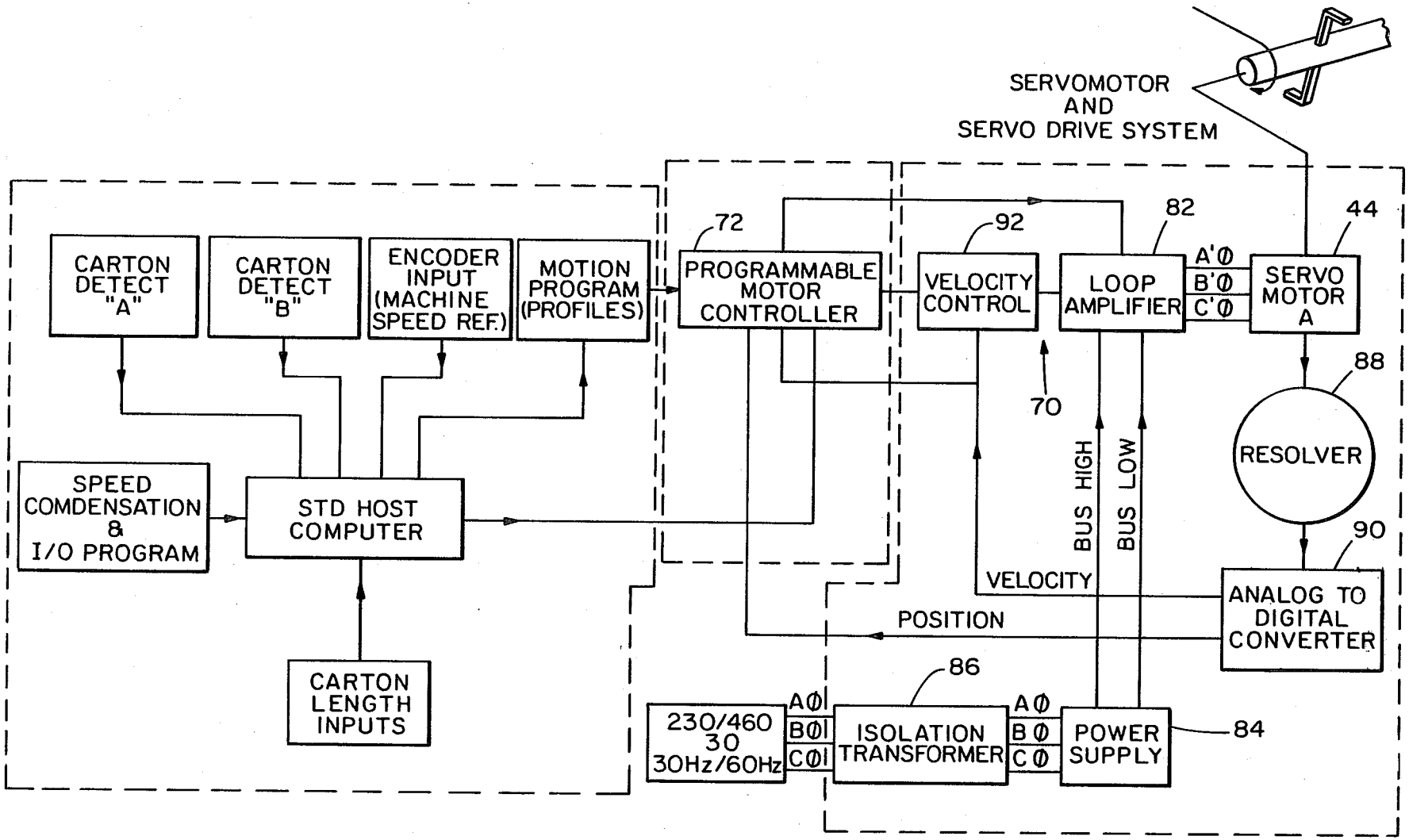
FIG. 6 is a more detailed block diagram of the hardware and software components of the system of FIG. 4.

Referring to FIGS. 5 and 6, each servo drive 70 includes a fully regenerative four-quadrant bi-directional velocity loop amplifier 82 which receives 300 v. dc power derived from full-wave recitification of three-phase ac by a power supply 84 connected to the three-phase line through an isolation transformer 86. Each motor 44 is a high performance permanent magnet brushless motor utilizing high energy neodymium-iron-boron alloys. Each motor has a permanent magnet rotor and a three-phase Y stator winding. Each motor runs as a synchronous motor (the rotor speed is identical to the frequency of the rotating stator magnetic field). The operation of the amplifier is enabled and controlled by inputs from its associated programmable motor controller 72 and, in response, supplies power to the portions of the stator winding. A brushless resolver 88 provides feedback as to precise rotor position and is mounted internally as part of the overall motor construction. More specifically, as known to those of skill in the art, such a resolver is a mechanical transducing device which develops an output related to the sine of the shaft angle. This analog output is converted by an analog to digital converter 90 which provides the digital feedback to the programmable motor controller 72. The resolver 88 can provide a binary coded decimal 12 bit output in which the 360 degrees of shaft rotation are indicated by 4096 discrete outputs of the converter. Thus a given binary coded decimal output of the converter 90 indicates the position of the rotor of a motor 44 (and therefore the position of a corresponding folder head 68) within 6 minutes of one degree. The resolver 88 also provides an output indicating the angular velocity of the rotor. This position feedback is input into the programmable motor controller 72 and the velocity feedback is input both to the controller and to a velocity control 92 which is part of the commercially available servo drive 70.

The commercially available programmable motor controller includes a microcomputer. In combination the servo drive 70, servomotor 44 and resolver 88, the controller forms a closed loop digital position system. Software specifying acceleration, velocity and distance can be loaded into memory associated with the controller and is used to operate the controller. As will be discussed hereafter, this permits the ability to control motion profiles for various portions of the cycle of operation of the folding head 68, and software can be written for various tuning parameters. The shaft encoder 76 provides pulses indicating conveyor speed.

These pulses are conditioned and multiplied by the controller to provide the time base for execution of software commands.

The software in the programmable motor controller memory typically contains several programs which can be selected by means of the operator setting a switch 96 (which provides a binary coded decimal output) to the number of the desired program. Among the programs may be ones designed for static testing of the trailing panel folding system and for run testing of the system. Following are programs, written in the language used by the commercially available programmable motor controller, relating to power up of the system, initial setting of the folding head, and folding of the carton blank:

| COMMENTS | |
|---|---|
| @@_POWERUP | |
| D1000 | Wait for 1 second for amplifier to cycle up |
| FP | Go sub to power up initialize program. |
| BC | Branch to cartonfold program. |
| E | End of program. |
| @P-POWERUP | |
| TP5 | Position loop gain. |
| TV50 | Velocity loop gain. |
| TF50 | Feed forward loop gain. |
| TCP0 | Position loop compensator. |
| TCV8 | Velocity loop compensator. |
| SY00 | Set S-curve acceleration profile. |
| SX9 | Set 192 kHz range and direction invert. |
| N0+ | Normalize this position to absolute zero. |
| SM2 | Enable position mode. |
| D1000 | Delay for 1 sec. |
| BH | Branch to home program. |
| @H-HOME | |
| A100 | Set default acceleration to 100000 CTS/SEC/SEC. |
| V200 | Set default velocity to 20000 CTS/SEC. |
| I124+ | Index 124 counts in the positive direction after stopped. |
| D50 | Dwell for 50 msec. |
| H200,− | Home to marker pulse in negative direction at 20000 CTS/SEC. |
| D50 | Dwell for 50 msec. |
| HI,+ | Home to marker pulse in positive direction at 400 CTS/SEC. |
| D50 | Dwell for 50 msec. |
| I670,+ | Index 670 counts in the positive direction to set start position |
| D50 | Dwell for 50 msec. |
| N0,+ | Set the current system position to absolute zero. |
| G! | Move to specified start position. |
| E | Exit program to idle state. |
| @C-CARTONFOLD | |
| TF0 | Set feed forward compensation to 0. |
| TP13 | Set position loop gain to 13. |
| SX49 | Cut on bus slave, 192 kHz mode, and direction invert. |
| @F-FOLD | |
| V4000 | 40000 CTS/SEC × 100 × 100/100000 CTS/SEC (scaled to .0190%). |
| A20 | 100000 CTS/SEC × .02 SEC/100 (scaled by 100). |
| U-1 | Wait until fold signal before making first move. |
| I950+ | Index 950 resolver counts in positive direction. |
| V5000 | 50000 CTS/SEC × 100 × 100/100000 CTS/SEC. |
| A20 | 100000 CTS/SEC × .02 SEC/100. |
| U-2 | Wait until recover signal before making second move. |
| I1098+ | Index 1098 resolver counts in positive direction. |
| BF | Branch to fold. |

The "POWERUP" program sets the various tuning parameters for the amplifier 82. The "HOME" program, which runs with respect to an internal programmable motor controller oscillator to establish clock pulses, sets the starting position of the folder head 68. Note that the position of the folder head shown in position 2 in FIG. 4 corresponds to 670 resolver counts from a predetermined home position. As 4096 resolver counts equal one revolution of the shaft, and as there are two folding heads on the assembly, one cycle of operation (from one start position to the next start position) is equal to 2048 resolver counts.

When the programmable motor controller branches to the "CARTONFOLD" program, the clock signals are not generated internally by the controller, but the encoder output (which is conditioned to be a 4 phase signal) serves as an external oscillator to coordinate timing of the controller with the speed of the conveyor 26. The host computer 74 is programmed to provide a "FOLD" signal based upon (a) detection of the panel trailing edge by the sensor 78, (b) the conveyor speed as indicated by the output of the shaft encoder 76, (c) the length of the trailing panel as indicated by the setting of binary coded decimal switch 80 and the contents of the "look-up" table in the host computer memory to compensate for the fixed response time of the motor/shaft assemblies regardless of the conveyor speed. The various relationships in the "look-up" table can be determined empirically or theoretically. After the delay following detection of passage of the panel trailing end 30, the host computer 74 provides the "FOLD" signal to cause the folder head 68 to be moved from its start position (position 2 of FIG. 4) to its folding or up position shown in position 5 of FIG. 4. The host computer is programmed to determine a dwell time, based on conveyor speed and trailing panel length, to give the folded panel time to be advanced from under the folder head 68. After expiration of this dwell time, the host computer 74 provides the "RECOVER" signal causing the folding head to be advanced to the other start position of the folding head assembly (180 degrees from the first starting position).

Referring to the "FOLD" program, the angular spacing between the first start position of the folding head to the fold position is represented by 950 resolver counts (slightly less than 90 degrees). This is referred to in the program as the first move. The angular spacing between the fold position and the second start position is 1098 resolver counts (slightly greater than 90 degrees). This is referred to in the program as the second move. The first move is made according to a first acceleration/velocity profile an example of which is shown in FIG. 10 while the second move is made in accordance with a second acceleration/velocity profile an example of which is depicted in FIG. 11. The maximum velocity in the second move is usually greater than that in the first move to permit closer spacing between carton blanks than would be possible with a system using identical maximum velocities in both moves.

A signal conditioning circuit for providing a sharply defined 5 V. DC output in response to detection of the passage of a carton trailing panel is shown in FIG. 7. The circuit includes a low pass filter receiving the output of the sensor 78. The circuit includes a capacitor C1 connected to ground for protecting against transient AC peaks and a pull-up resistor R1 connected from 5 V. DC to an open-collector transistor (forming an inverter I1) through a coupling resistor R2.

Circuitry for conditioning the output of the encoder 76, which provides an A channel and a B channel (with pulses of the B channel lagging those on the A channel by 90 degrees), is shown in FIG. 8. Each channel is fed through a low-pass filter and a coupling resistor to an inverter, as discussed above with reference to FIG. 7. The output of the channel A inverter I2 is itself inverted by an inverter I4 to provide an A′ output while the output of I2 is an $\overline{A}'$ output. Similarly, the output of channel B inverter I3 is the $\overline{B}'$ output which is inverted by I5 for the conditioned B′ output. This four-phase output is provided to the programmable motor controllers 72 and to the host computer 74 to provide the time base related to conveyor velocity. An integrated circuit IC divides the output of inverter I3 by 2 with the IC output inverted by inverters I6 and I7 to provide timing signals for other components of the machine 22.

FIG. 9 illustrates a circuit for, in essence, generating a square wave of milliseconds duration for one of the programmable motor controller 72 in response to the microsecond "FOLD" or "RECOVER" signals generated by the host computer 74. A total of four such circuits are employed for the "FOLD" and "RECOVER" signals for the two controllers. A one-shot multivibrator 98 provides a square wave of a duration determined by the value of a capacitor C2 upon receiving the pulse from the host computer 74.

As a method of folding trailing panels 28 or 30 of carton blanks 24 conveyed in a predetermined direction in untimed relationship to one another along a generally horizontal path by means of a folding head adapted to fold a trailing panel and mounted on a rotatable shaft driven by a motor, the present invention includes several steps:

(a) the folding head is positioned so that is in a start position in which it is below the pass path of the carton;

(b) the passage of a carton blank is detected upstream of the shaft;

(c) upon expiration of a delay period after the detection, the folder head is accelerated to a first maximum angular velocity to move the folding head toward an up position overlying a trailing panel resulting in the trailing panel being folded;

(d) the folding head is maintained in this up position until the folded panel is advanced from under the head; and (e) the folding head is returned to a start position in which the head is disposed below the pass path of the carton blanks by accelerating the head to a maximum angular velocity greater than the first-mentioned angular velocity.

Referring to pages 19–20, there is set forth a code listing for the Forth (a commonly used high level programming language) program which runs on the PRO-LOG Z-80A board (card) which includes the memory of the host computer. This source code is compiled and the output of the compiler is binary object code which is converted to Hex object code and then loaded into a prom-programmer and burned into the prom (memory of the host computer).

The following is a brief description of the source listing:

(1) Pages 19 and 20 are an index listing of the various screens which make up the program. The first column is the screen number followed by a screen title which corresponds to line zero (0) of each screen. Forth programs are a collection of screens (16 lines×64 characters or 1024 bytes total) which use Forth words to define other procedures which are named by a single word.

(2) Screens 0 thru 8 are screens which either explain the program or list error messages which can be used.

(3) Screens 9 thru 55 are standard Romable source listings supplied by Laboratory Microsystems as part of its PC/Forth 3.10 package.

(4) Screens 56 thru 59 are additional Forth screens which are utilities which are used in developing the application source code.

(5) Screens 60 thru 89 are the screens which make up the program which creates the user interface for the Trailing Panel Folder. Screens 60 thru 69 are general initialization routines for the two PRO-LOG boards. Screens 72 thru 77 are the screens for the interrupt service routines of the encoder pulses which create signals A-Fold, A-Recover, B-Fold and B-Recover. Screens 78 thru 82 are screens which convert BCD information to counter pre-sets for software counters. Screen 83 is used to initialize the application on power-up.

(6) Screens 84 thru 86 are the main routines for the program. Screens 87 thru 88 set the baud rate for communication to an external Terminal.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

```
 0 ( Stand-alone ROMable Z-80 FORTH source code )
 1 ( Explanation of load screens )
 2 ( Screen printing utility SHOW )
 3
 4 ( System messages )
 5 ( System messages )
 6 ( Error messages for Cross Compiler's Z-80 Assembler )
 7 ( Load screen for cross-compilation of Z-80 ROMable system )
 8 ( spare )
 9 ( ROMable Z-80 FORTH --- Equates )
10 ( ROMable Z-80 FORTH --- initialization )
11 ( ROMable Z-80 FORTH --- Cold start )
12 ( ROMable Z-80 FORTH --- Inner interpreter and warm start )
13 ( ROMable Z-80 FORTH --- lit execute branch 0branch )
14 ( ROMable Z-80 FORTH --- (loop (do )
```

```
15 ( ROMable Z-80 FORTH --- (+loop )
16 ( ROMable Z-80 FORTH --- i j digit )
17 ( ROMable Z-80 FORTH --- (find )
18 ( ROMable Z-80 FORTH --- (find )
19 ( ROMable Z-80 FORTH --- enclose )
20 ( ROMable Z-80 FORTH --- cmove )
21 ( ROMable Z-80 FORTH --- u* )
22 ( ROMable Z-80 FORTH --- mpyx )
23 ( ROmable Z-80 FORTH --- u/ )
24 ( ROMable Z-80 FORTH --- u/ )
25 ( ROMable Z-80 FORTH --- and or xor )
26 ( ROMable Z-80 FORTH --- sp@ sp! rp@ rp! )
27 ( ROMable Z-80 FORTH --- ;s leave >r r> )
28 ( ROMable Z-80 FORTH --- r 0= 0< + )
29 ( ROMable Z-80 FORTH --- d+ d- )
30 ( ROMable Z-80 FORTH --- minus dminus over )
31 ( ROMable Z-80 FORTH --- drop 2drop swap dup 2dup )
32 ( ROMable Z-80 FORTH --- +! toggle @ )
33 ( ROMable Z-80 FORTH --- c@ 2@ ! )
34 ( ROMable Z-80 FORTH --- c! 2! 1+ 2+ )
35 ( ROMable Z-80 FORTH --- 1- 2- - = )
36 ( ROMable Z-80 FORTH --- < > fill )
37 ( ROMable Z-80 FORTH --- p@ p! )
38 ( ROMable Z-80 FORTH --- s= )
39 ( ROMable Z-80 FORTH --- rot s->d mon )
40 ( ROMable Z-80 FORTH --- constant user : does> )
41 ( ROMable Z-80 FORTH --- variable & vocabulary )
42 ( ROMable Z-80 FORTH --- user-definitions )
43 ( ROMable Z-80 FORTH --- +origin cfa latest traverse pfa )
44 ( ROMable Z-80 FORTH --- ?comp compile literal count type )
45 ( ROMable Z-80 FORTH --- m/mod # #s d+- dabs +- abs m/ /mod )
46 ( ROMable Z-80 FORTH --- spaces d.r d. .cpu m* * */mod u. )
47 ( ROMable Z-80 FORTH --- terminal I/O )
48 ( ROMable Z-80 FORTH --- message (abort error number ?exec )
49 ( ROMable Z-80 FORTH ---  u< ?stack blanks word -find nfa etc.)
50 ( ROMable Z-80 FORTH --- expect null min create interpret )
51 ( ROMable Z-80 FORTH --- query quit definitions decimal etc. )
52 ( ROMable Z-80 FORTH --- erase ?pairs back begin endif etc. )
53 ( ROMable Z-80 FORTH --- +loop until end again repeat if etc. )
54 ( ROMable Z-80 FORTH --- .r hex immediate [compile] ' ." warm )
55 ( ROMable Z-80 FORTH --- mod ? forget vlist noop task )
56 ( OMT utilities: DUMP, PICK, ROLL, MSEC, >< )          DECIMAL
57 ( OMT utilities: DEPTH .S CS .US STKON STKOFF EXIT )   DECIMAL
58 ( OMT utilities: SCALL, decompiler N L S )             DECIMAL
59 ( OMT utilities: CLS  XY )                             DECIMAL
60 ( CLS, XY, cont )                                      DECIMAL
61 ( MODE2, ENABLE/DISABLE-INT )  HEX
62 ( Post: assignments for 7606 and RTI-1225 )            HEX
63 ( Post: misc variables: CTC2 )                         HEX
64 ( Post: misc variables: FLAGs and COUNTs )             DECIMAL
65 ( Post: ISR-7606-1A, trailing edge photocell )         HEX
66 ( Post: ISR-7606-2A, trailing edge photocell )         HEX
67 ( INIT-7606-1 )                                        HEX
68 ( INIT-7606, -2 )                                      HEX
69 ( EN/DISABLE-7606 )                                    HEX
70 ( spare )
71 ( spare )
```

```
72 ( ISR-CTC1, main encoder pulses/n )
73 ( ISR-CTC1, main encoder pulses/n, cont: A-FOLD )
74 ( ISR-CTC1, main encoder pulses/n, cont: A-RECOVER )
75 ( ISR-CTC1, main encoder pulses/n, cont: B-FOLD )
76 ( ISR-CTC1, main encoder pulses/n, cont: B-RECOVER )
77 ( ISR-CTC2 )                                                HEX
78 ( INIT-CTC-ISV/1/2 )                                        HEX
79 ( INIT-ISV )
80 ( BLINK, RPT-BLINK )                                        HEX
81 ( A/B-FLAP-SW>MILS )                                        DECIMAL
82 ( OFFSET-TABLE, OC@/!, INIT-OFFSET-TABLE,SPEED-OFFSET )     DECIMAL
83 ( INIT-APPLIC )                                             DECIMAL
84 ( .INFO )
85 ( MILS>COUNTS, SET-A/B/RECOVER-OFFSET                       11/8/85 )
86 ( MAIN )
87 ( PTEST, 600BAUD, 9600BAUD )
88 ( PTEST, 600BAUD, 9600BAUD )
89
```

Screen # 0

```
( Stand-alone ROMable Z-80 FORTH source code )
for use with Nautilus Systems Cross Compiler
( Z-80 target version )
(c) 1981 by      Ray Duncan, Laboratory Microsystems
                             4147 Beethoven Street
                             Los Angeles, CA 90066
Revised for Prolog 7806 CPU board by R.K.Jenner, OMT, Inc.
23 may 85  added interrupt handlers for ctc3/dojen/noog
 2 oct 85  revised for 7806-0 ( 4 MHz ), and for Post demo
10 oct 85  remapped for 16/32k PROM, and RAM at A000 - BFFF
```

Screen # 1

```
( Explanation of load screens )
;S

( Cross-compiling:                                          )
( First edit screen 9 to set origin and memory size.        )
( From CP/M, type: A)CROSSZ80 ROMZ80.SCR (return).          )
( wait for system id.  then type:                           )
( 7 LOAD  (return)                                          )
( Target image is left in file IMAGE.COM on current disk.   )
;S
```

Screen # 2

```
( Screen printing utility SHOW )
( displays triads on list device )
( command format:  n1 n2 SHOW  )
0 VARIABLE FF.FLAG
: SHOW
  FF.FLAG @ 0=
  IF CR ." Does your printer have form feed capability? " KEY
  DUP EMIT 89 = IF 2 ELSE 1 ENDIF FF.FLAG ! CR ENDIF
  SWAP PRINTER
  DO I TRIAD
    FF.FLAG @ 1 =
    IF CR CR CR CR CR CR CR ENDIF
  3 +LOOP
  CONSOLE
  ;
```

Screen # 3

Screen # 4

```
( System messages )
empty stack
dictionary full
has incorrect address mode
isn't unique

disc range ?
full stack
disc error !
```

Screen # 5

```
( System messages )
compilation only, use in definition
execution only
conditionals not paired
definition not finished
in protected dictionary
use only when loading
off current editing screen
declare vocabulary
```

```
BASE must be DECIMAL
missing decimal point
Z-80 FORTH                    Laboratory Microsystems
```

Screen # 6

```
( Error messages for Cross Compiler's Z-80 Assembler )
16 bit register not allowed
8 bit register not allowed
address out of range
immediate data value not allowed
missing source register
missing destination register
illegal operation
illegal operand
instruction not implemented
illegal destination register
illegal source register
illegal condition code
register mismatch
destination address missing
```

Screen # 7

```
( Load screen for cross-compilation of Z-80 ROMable system )

DECIMAL
CR ." 4-CORNER V.8 S/W for 7806-0 CPU board;" CR
CR ." updated 11/12/85." CR
CROSS-COMPILE

DECIMAL 09 57 THRU  ( LMI nucleus )
DECIMAL 58 87 THRU  ( application )
: TASK          ; IS-FENCE      FINIS

;S
```

Screen # 8

```
( spare )
```

Screen # 9

```
( ROMable Z-80 FORTH --- Equates )
  HEX 0000    0 ORG/DB          ( for 7806: 16k PROM at 0000; )
( HEX 8000 8000 ORG/IMG  )
      A000 1F00 ROM/RAM         ( 8k RAM at A000 - BFFF       )
          BF00 MEM-END

 1 EQU FIGREL    1 EQU FIGVER    0 EQU USRVER   20 EQU ABL
0D EQU ACR      2E EQU ADOT     07 EQU BELL      8 EQU BSIN
 8 EQU BSOUT    10 EQU DLE      0A EQU LF       0C EQU FFEED

040 EQU US                      0A0 EQU RTS
EM US - EQU INIT-R0             INIT-R0 RTS - EQU INIT-S0

F5 EQU STATUS-PORT  01 EQU RDA  ( receive data available )
F4 EQU DATA-PORT    04 EQU TBE  ( transmit buffer empty )
;S
```

Screen # 10

```
( ROMable Z-80 FORTH --- initialization )
ASSEMBLER
NOP ECLD JP   NOP  EWRM JP
FORTH
FIGREL C, FIGVER C, USRVER C, DE C,
HERE LABEL INIT-FORTH 0 ,
BSIN , INIT-R0 , INIT-S0 , INIT-R0 , INIT-S0 , 01F , 0 ,
HERE LABEL INIT-FENCE 0 ,
HERE LABEL INIT-DP 0 ,
HERE LABEL INIT-VOC-LINK 0 , BASE-36 Z80. , , HEX
THERE LABEL RPP  INIT-R0 THERE !  2 ALLOT-RAM
THERE LABEL UP   INIT-R0 THERE !  2 ALLOT-RAM
FORTH ;S
```

Screen # 11

```
( ROMable Z-80 FORTH --- Cold start )
ASSEMBLER
HERE LABEL ECLD

      BC, # CLD1     LD
      SP, # INIT-S0  LD
      IY, # INIT-R0  LD
      NEXT JP

HERE LABEL CLD1  ] COLD [

FORTH ;S
```

Screen # 12

```
( ROMable Z-80 FORTH --- Inner interpreter and warm start )

ASSEMBLER
HERE LABEL EWRM     BC, # WRM1 LD    NEXT JP
HERE LABEL WRM1     ] WARM [
```

Screen # 13

```
( ROMable Z-80 FORTH --- lit execute branch 0branch )
FORTH DEFINITIONS
CODE LIT        A, (BC) LD      BC INC          L, A LD
                A, (BC) LD      BC INC          H, A LD
                HPUSH JP        END-CODE
```

```
ASSEMBLER
HERE LABEL DPUSH   DE PUSH
HERE LABEL HPUSH   HL PUSH
HERE LABEL NEXT    A, (BC) LD    BC INC    L, A LD
                   A, (BC) LD    BC INC    H, A LD
HERE LABEL NEXT1   E, (HL) LD    HL INC    D, (HL) LD
                   DE, HL EX     (HL) JP
FORTH ;S
```

Screen # 14

```
( ROMable Z-80 FORTH --- (loop (do )

CODE (LOOP)    (IY) INC       NZ, XL001 JP    1 (IY) INC
               HERE LABEL XL001               A, (IY) LD
               A, 2 (IY) SUB  A, 1 (IY) LD    A, 3 (IY) SBC
               M, BRAN1 JP    DE, # 4 LD      IY, DE ADD
               BC INC         BC INC          NEXT JP
               END-CODE

CODE (DO)      DE, # -4 LD    IY, DE ADD      DE POP
               (IY), E LD     1 (IY), D LD    DE POP
               2 (IY), E LD   3 (IY), D LD    NEXT JP
               END-CODE
;S
```

Screen # 16

```
( ROMable Z-80 FORTH --- i j digit )

CODE I         E, (IY) LD     D, 1 (IY) LD    DE PUSH
               NEXT JP        END-CODE

CODE J         E, 4 (IY) LD   D, 5 (IY) LD    DE PUSH
               NEXT JP        END-CODE

CODE DIGIT     HL POP         DE POP          A, E LD
               A, # 30 SUB    M, DIGI2 JP     A, # 0A CP
               M, DIGI1 JP    A, # 7 SUB      A, # 0A CP
               M, DIGI2 JP    HERE LABEL DIGI1
               A, L CP        P, DIGI2 JP     E, A LD
               HL, # 1 LD     DPUSH JP
               HERE LABEL DIGI2               L, H LD
               HPUSH JP       END-CODE                ;S
```

Screen # 18

```
( ROMable Z-80 FORTH --- (find )

               HERE LABEL PFIN3               CY, PFIN5 JR
               HERE LABEL PFIN4               DE INC
               A, (DE) LD     A, A OR         P, PFIN4 JP
               HERE LABEL PFIN5               DE INC
               DE, HL EX      E, (HL) LD      HL INC
               D, (HL) LD     A, D LD         A, E OR
               NZ, PFIN1 JR   HL POP          HL, # 0 LD
               HPUSH JP
               END-CODE
```

```
CODE EXECUTE   HL POP         NEXT1 JP        END-CODE

CODE BRANCH    HERE LABEL BRAN1               H, B LD
               L, C LD        C, (HL) LD      HL INC
               B, (HL) LD     NEXT JP         END-CODE

CODE OBRANCH   HL POP         A, L LD         A, H OR
               Z, BRAN1 JP    BC INC          BC INC
               NEXT JP        END-CODE
;S
```

Screen # 15

```
( ROMable Z-80 FORTH --- (+loop )

CODE (+LOOP)   DE POP         A, D LD         A, A OR
               M, XPL001 JP   L, (IY) LD      H, 1 (IY) LD
               HL, DE ADD     (IY), L LD      1 (IY), H LD
               E, 2 (IY) LD   D, 3 (IY) LD    A, A OR
               HL, DE SBC     M, BRAN1 JP
               HERE LABEL XPL000              DE, # 4 LD
               IY, DE ADD     BC INC          BC INC
               NEXT JP
               HERE LABEL XPL001              L, (IY) LD
               H, 1 (IY) LD   HL, DE ADD      (IY), L LD
               1 (IY), H LD   E, 2 (IY) LD    D, 3 (IY) LD
               DE, HL EX      A, A OR         HL, DE SBC
               M, BRAN1 JP    XPL000 JR       END-CODE
;S
```

Screen # 17

```
( ROMable Z-80 FORTH --- (find )

CODE (FIND)    DE POP         HERE LABEL PFIN1
               HL POP         HL PUSH         A, (DE) LD
               A, (HL) XOR    A, # 03F AND    NZ, PFIN4 JP
               HERE LABEL PFIN2               HL INC
               DE INC         A, (DE) LD      A, (HL) XOR
               A, A ADD       NZ, PFIN3 JP    NCY, PFIN2 JP
               HL, # 5 LD     HL, DE ADD      (SP), HL EX
               HERE LABEL PFIN6               DE DEC
               A, (DE) LD     A, A OR         P, PFIN6 JP
               E, A LD        D, # 0 LD       HL, # 1 LD
               DPUSH JP
;S
```

Screen # 19

```
( ROMable Z-80 FORTH --- enclose )

CODE ENCLOSE   DE POP         HL POP          HL PUSH
               A, E LD        D, A LD         E, # -1 LD
               HL DEC
               HERE LABEL ENCL1               HL INC
               E INC          A, (HL) CP      Z, ENCL1 JR
               D, # 0 LD      DE PUSH         D, A LD
               A, (HL) LD     A, A AND        NZ, ENCL2 JR
               D, # 0 LD      E INC           DE PUSH
               E DEC          DE PUSH         NEXT JP
```

```
;S
```

Screen # 20

```
( ROMable Z-80 FORTH --- cmove )

            HERE LABEL EMCL3            D, # 0 LD
            DE PUSH        DE PUSH      NEXT JP
            HERE LABEL EMCL4            D, # 0 LD
            DE PUSH        E INC        DE PUSH
            NEXT JP
            END-CODE

CODE CMOVE  EXX            BC POP       DE POP
            HL POP         A, B LD      A, C OR
            Z, CMOVE2 JR   LDIR
            HERE LABEL CMOVE2
            EXX            NEXT JP      END-CODE
```

Screen # 21

```
( ROMable Z-80 FORTH --- u* )

CODE U*     DE POP         HL POP       BC PUSH
            B, H LD        A, L LD      MPYX CALL
            HL PUSH        H, A LD      A, B LD
            B, H LD        MPYX CALL    DE POP
            C, D LD        HL, BC ADD   A, # 0 ADC
            D, L LD        L, H LD      H, A LD
            BC POP         DE PUSH      HPUSH JP
            END-CODE
;S
```

Screen # 22

```
( ROMable Z-80 FORTH --- mpyx )
ASSEMBLER

HERE LABEL MPYX
            HL, # 0 LD     C, # 8 LD
            HERE LABEL MPYX1
            HL, HL ADD     RLA
            NCY, MPYX2 JP  HL, DE ADD   A, # 0 ADC
            HERE LABEL MPYX2
            C DEC          NZ, MPYX1 JP RET

FORTH
;S
```

Screen # 23

```
( ROMable Z-80 FORTH --- u/ )

CODE U/     EXX            BC POP       HL POP
            DE POP         A, L LD      A, C SUB
            A, H LD        A, B SBC     CY, USLA1 JP
            HL, # -1 LD    DE, # -1 LD  USLA7 JP
            HERE LABEL USLA1            A, # 10 LD
            HERE LABEL USLA2            HL, HL ADD
            RLA            DE, HL EX    HL, HL ADD
            NCY, USLA3 JR  DE INC       A, A AND
            HERE LABEL USLA3            DE, HL EX
            RRA            AF PUSH      NCY, USLA4 JR
            A, A OR        HL, BC SBC   USLA5 JR
;S
```

Screen # 24

```
( ROMable Z-80 FORTH --- u/ )

            HERE LABEL USLA4            A, A OR
            HL, BC SBC     NCY, USLA5 JR HL, BC ADD
            DE DEC
            HERE LABEL USLA5            DE INC
            HERE LABEL USLA6            AF POP
            A DEC          NZ, USLA2 JR
            HERE LABEL USLA7            HL PUSH
            DE PUSH        EXX          NEXT JP
            END-CODE
;S
```

Screen # 25

```
( ROMable Z-80 FORTH --- and or xor )

CODE AND    DE POP         HL POP       A, E LD
            A, L AND       L, A LD      A, D LD
            A, H AND       H, A LD      HPUSH JP
            END-CODE

CODE OR     DE POP         HL POP       A, E LD
            A, L OR        L, A LD      A, D LD
            A, H OR        H, A LD      HPUSH JP
            END-CODE

CODE XOR    DE POP         HL POP       A, E LD
            A, L XOR       L, A LD      A, D LD
            A, H XOR       H, A LD      HPUSH JP
            END-CODE       ;S
```

Screen # 26

```
( ROMable Z-80 FORTH --- sp@ sp! rp@ rp! )

CODE SP@    HL, # 0 LD     HL, SP ADD   HPUSH JP
```

Screen # 27

```
( ROMable Z-80 FORTH --- ;s leave >r r> )

CODE ;S     C, (IY) LD     IY INC       B, (IY) LD
```

```
            END-CODE

CODE SP!    HL, UP LD       DE, # 6 LD      HL, DE ADD
            E, (HL) LD      HL INC          D, (HL) LD
            DE, HL EX       SP, HL LD       NEXT JP
            END-CODE

CODE RP@    IY PUSH         NEXT JP         END-CODE

CODE RP!    HL, UP LD       DE, # 8 LD      HL, DE ADD
            E, (HL) LD      HL INC          D, (HL) LD
            DE PUSH         IY POP          NEXT JP
            END-CODE        ;S
```

Screen # 28

```
( ROMable Z-80 FORTH --- r 0= 0< + )

CODE R      E, (IY) LD      D, 1 (IY) LD    DE PUSH
            NEXT JP         END-CODE

CODE 0=     HL POP          A, L LD         A, H OR
            HL, # 0 LD      NZ, HPUSH JP    HL INC
            HPUSH JP        END-CODE

CODE 0<     HL POP          A, H LD         A, A OR
            HL, # 0 LD      P, HPUSH JP     HL INC
            HPUSH JP        END-CODE

CODE +      DE POP          HL POP          HL, DE ADD
            HPUSH JP        END-CODE
;S
```

Screen # 29

```
( ROMable Z-80 FORTH --- d+ d- )

CODE D+     EXX             BC POP          DE POP
            HL POP          (SP), HL EX     HL, DE ADD
            DE, HL EX       HL POP          HL, BC ADC
            DE PUSH         HL PUSH         EXX
            NEXT JP         END-CODE

CODE D-     EXX             BC POP          DE POP
            HL POP          (SP), HL EX     A, A OR
            HL, DE SBC      DE, HL EX       HL POP
            HL, BC SBC      DE PUSH         HL PUSH
            EXX             NEXT JP         END-CODE
;S
```

Screen # 30

```
( ROMable Z-80 FORTH --- minus dminus over )

CODE MINUS  DE POP          HL, # 0 LD      A, A OR
            HL, DE SBC      HPUSH JP        END-CODE

CODE DMINUS EXX             DE POP          BC POP
            HL, # 0 LD      A, A OR         HL, BC SBC
            HL PUSH         HL, # 0 LD      HL, DE SBC
            HL PUSH         EXX             NEXT JP
            END-CODE

CODE OVER   DE POP          HL POP          HL PUSH
            DPUSH JP        END-CODE
;S
```

Screen # 31

```
( ROMable Z-80 FORTH --- drop 2drop swap dup 2dup )

CODE DROP   HL POP          NEXT JP         END-CODE

CODE 2DROP  HL POP          HL POP          NEXT JP
            END-CODE

CODE SWAP   HL POP          (SP), HL EX     HPUSH JP
            END-CODE

CODE DUP    HL POP          HL PUSH         HPUSH JP
            END-CODE

CODE 2DUP   HL POP          DE POP          DE PUSH
            HL PUSH         DPUSH JP        END-CODE
;S
```

Screen # 32

```
( ROMable Z-80 FORTH --- +! toggle @ )

CODE +!     HL POP          DE POP          A, (HL) LD
            A, E ADD        (HL), A LD      HL INC
            A, (HL) LD      A, D ADC        (HL), A LD
            NEXT JP         END-CODE
```

Screen # 33

```
( ROMable Z-80 FORTH --- c@ 2@ ! )

CODE C@     HL POP          L, (HL) LD      H, # 0 LD
            HPUSH JP        END-CODE

CODE 2@     HL POP          DE, # 3 LD      HL, DE ADD
            D, (HL) LD      HL DEC          E, (HL) LD
            IY INC          NEXT JP         END-CODE

CODE LEAVE  E, (IY) LD      D, 1 (IY) LD    2 (IY), E LD
            3 (IY), D LD    NEXT JP         END-CODE

CODE >R     DE POP          IY DEC          IY DEC
            (IY), E LD      1 (IY), D LD    NEXT JP
            END-CODE

CODE R>     E, (IY) LD      IY INC          D, (IY) LD
            IY INC          DE PUSH         NEXT JP
            END-CODE
;S
```

```
CODE TOGGLE   DE POP        HL POP        A, (HL) LD
              A, E XOR      (HL), A LD    NEXT JP
              END-CODE

CODE @        HL POP        E, (HL) LD    HL INC
              D, (HL) LD    DE PUSH       NEXT JP
              END-CODE
;S
```

Screen # 34

```
( ROMable Z-80 FORTH --- c! 2! 1+ 2+ )

CODE C!       HL POP        DE POP        (HL), E LD
              NEXT JP       END-CODE

CODE 2!       HL POP        DE POP        (HL), E LD
              HL INC        (HL), D LD    HL INC
              DE POP        (HL), E LD    HL INC
              (HL), D LD    NEXT JP

CODE 1+       HL POP        HL INC        HPUSH JP
              END-CODE

CODE 2+       HL POP        HL INC        HL INC
              HPUSH JP      END-CODE
;S
```

```
              DE PUSH       HL DEC        D, (HL) LD
              HL DEC        E, (HL) LD    DE PUSH
              NEXT JP       END-CODE

CODE !        HL POP        DE POP        (HL), E LD
              HL INC        (HL), D LD    NEXT JP
              END-CODE
;S
```

Screen # 35

```
( ROMable Z-80 FORTH --- 1- 2- - = )

CODE 1-       HL POP        HL DEC        HPUSH JP
              END-CODE

CODE 2-       HL POP        HL DEC        HL DEC
              HPUSH JP      END-CODE

CODE -        DE POP        HL POP        A, A OR
              HL, DE SBC    HPUSH JP      END-CODE

CODE =        HL POP        DE POP        A, A XOR
              HL, DE SBC    H, A LD       L, A LD
              NZ, HPUSH JP  HL INC        HPUSH JP
              END-CODE
;S
```

Screen # 36

```
( ROMable Z-80 FORTH --- ( ) fill )

CODE (        DE POP        HL POP        A, A OR
              HL, DE SBC    HL, # 1 LD    M, HPUSH JP
              HL DEC        HPUSH JP      END-CODE

CODE )        HL POP        DE POP        A, A OR
              HL, DE SBC    HL, # 1 LD    M, HPUSH JP
              HL DEC        HPUSH JP      END-CODE

CODE FILL     EXX           DE POP        BC POP
              HL POP        HERE LABEL FILL1
              A, B LD       A, C OR       Z, FILL2 JR
              (HL), E LD    HL INC        BC DEC
              FILL1 JP      HERE LABEL FILL2
              EXX           NEXT JP       END-CODE    ;S
```

Screen # 37

```
( ROMable Z-80 FORTH --- p@ p! )

CODE P@       EXX           BC POP        L, (C) IN
              H, # 0 LD     HL PUSH       EXX
              NEXT JP       END-CODE

CODE P!       EXX           BC POP        HL POP
              (C), L OUT    EXX           NEXT JP
              END-CODE

;S
```

Screen # 38

```
( ROMable Z-80 FORTH --- s= )

CODE S=       EXX           BC POP        HL POP
              DE POP
              HERE LABEL STREQ1
              A, B LD       A, C OR       Z, STREQ2 JR
              A, (DE) LD    CPI           NZ, STREQ3 JR
              DE INC        STREQ1 JP
              HERE LABEL STREQ2
              EXX           HL, # 1 LD    HPUSH JP
              HERE LABEL STREQ3
              EXX           HL, # 0 LD    HPUSH JP
;S
```

Screen # 39

```
( ROMable Z-80 FORTH --- rot s->d mon )

CODE ROT      DE POP        HL POP        (SP), HL EX
              DPUSH JP      END-CODE

CODE S->D     DE POP        HL, # 0 LD    A, D LD
              A, # 080 AND  Z, STOD1 JP   HL DEC
              HERE LABEL STOD1
              DPUSH JP      END-CODE

CODE MON      D JP END-CODE
;S
```

Screen # 40

```
( ROMable Z-80 FORTH --- constant user : does) )

: CONSTANT    CREATE SMUDGE ,
              ;CODE DE INC  DE, HL EX  E, (HL) LD  HL INC
              D, (HL) LD  DE PUSH  NEXT JP  END-CODE
: USER        CONSTANT
              ;CODE  DE INC  DE, HL EX  E, (HL) LD  D, # 0 LD
              HL, UP LD  HL, DE ADD  HPUSH JP   END-CODE
: :           ?EXEC !CSP CURRENT @ CONTEXT ! CREATE [COMPILE] ]
              ;CODE   IY DEC  (IY), B LD  IY DEC  (IY), C LD
              DE INC  C, E LD  B, D LD  NEXT JP   END-CODE
: DOES>       R> LATEST PFA !   ;CODE   IY DEC  (IY), B LD
              IY DEC  (IY), C LD  DE INC  DE, HL EX
              C, (HL) LD  HL INC  B, (HL) LD  HL INC
              HPUSH JP   END-CODE
;S
```

Screen # 41

```
( ROMable Z-80 FORTH --- variable & vocabulary )

: VARIABLE            CREATE SMUDGE HERE 2+ , , ;CODE
                      DE INC  DE, HL EX  E, (HL) LD  HL INC
                      D, (HL) LD  DE PUSH  NEXT JP  END-CODE

: VOCABULARY          <BUILDS HERE 4 + ,
                      HERE VOC-LINK @ , VOC-LINK !
                      A081 , CURRENT @ CFA ,
                      DOES> @ 2+ CONTEXT ! ;

VOCABULARY FORTH IMMEDIATE
;S
```

Screen # 42

```
( ROMable Z-80 FORTH --- user-definitions )

06 USER S0      08 USER R0            0A USER TIB
0C USER WIDTH   0E USER WARNING       10 USER FENCE
12 USER DP      14 USER VOC-LINK      16 USER BLK
18 USER IN      1A USER OUT           1C USER SCR
20 USER CONTEXT 22 USER CURRENT
24 USER STATE   26 USER BASE          28 USER DPL
3A USER FLD     2C USER CSP           2E USER R#
30 USER HLD
;S
```

Screen # 43

```
( ROMable Z-80 FORTH --- +origin cfa latest traverse pfa )
: +ORIGIN       ORIGIN + ;
: CFA           2 - ;
: LATEST        CURRENT @ @ ;
: TRAVERSE      SWAP BEGIN OVER + 07F OVER C@
                < UNTIL SWAP DROP ;
: PFA           1 TRAVERSE 5 + ;
: (;CODE)       R> LATEST PFA CFA ! ;
: HERE          DP @ ;
: ALLOT         DP +! ;
: ,             HERE ! 2 ALLOT ;
: !CSP          SP@ CSP ! ;
: HOLD          -1 HLD +! HLD @ C! ;
: SMUDGE        LATEST 20 TOGGLE ;
;S
```

Screen # 44

```
( ROMable Z-80 FORTH --- ?comp compile literal count type )
: ?COMP         STATE @ 0= 11 ?ERROR ;
: COMPILE       ?COMP R> DUP 2+ >R @ , ;
: LITERAL       STATE @ IF COMPILE LIT , ENDIF ; IMMEDIATE
: DLITERAL      STATE @ IF SWAP [COMPILE] LITERAL
                [COMPILE] LITERAL ENDIF ; IMMEDIATE
: COUNT         DUP 1+ SWAP C@ ;
: -DUP          DUP IF DUP ENDIF ;
: TYPE          -DUP IF OVER + SWAP DO I C@ EMIT LOOP
                ELSE DROP ENDIF ;
: (.")          R COUNT DUP 1+ R> + >R TYPE ;
: PAD           HERE 44 + ;
: #>            DROP DROP HLD @ PAD OVER - ;
: SIGN          ROT 0< IF 2D HOLD ENDIF ;
;S
```

Screen # 45

```
( ROMable Z-80 FORTH --- m/mod # #s d+- dabs +- abs m/ /mod )
: M/MOD         >R 0 R U/ R> SWAP >R U/ R> ;
: #             BASE @ M/MOD ROT 9 OVER < IF 7 + ENDIF
                30 + HOLD ;
: #S            BEGIN # 2DUP OR 0= UNTIL ;
: <#            PAD HLD ! ;
: D+-           0< IF DMINUS ENDIF ;
: DABS          DUP D+- ;
: +-            0< IF MINUS ENDIF ;
: ABS           DUP +- ;
: M/            OVER >R >R DABS R ABS U/ R> R XOR +-
                SWAP R> +- SWAP ;
: /MOD          >R S->D R> M/ ;
: /             /MOD SWAP DROP ;
: MAX           2DUP < IF SWAP ENDIF DROP ;
;S
```

Screen # 46

```
( ROMable Z-80 FORTH --- spaces d.r d. .cpu m* * */mod u. )
: SPACE         BL EMIT ;
: SPACES        0 MAX -DUP IF 0 DO SPACE LOOP ENDIF ;
: D.R           >R SWAP OVER DABS <# #S SIGN #> R>
                OVER - SPACES TYPE ;
```

Screen # 47

```
( ROMable Z-80 FORTH --- terminal I/O )
( port addresses and bit masks are equates in screen 9 )
HEX
: EMIT          BEGIN STATUS-PORT P@ TBE AND UNTIL
                DATA-PORT P! 1 OUT +! ;
```

```
: D.            0 D.R SPACE ;
: .CPU          BASE @ 24 BASE ! 22 +ORIGIN 2@ D. BASE ! ;
: .             S->D D. ;
: M*            2DUP XOR >R ABS SWAP ABS U* R> D+- ;
: *             M* DROP ;
: */MOD         >R M* R> M/ ;
: -TRAILING     DUP 0 DO OVER OVER + 1 - C@ BL - IF LEAVE
                ELSE 1 - ENDIF LOOP ;
: U.            0 D. ;
;S
```

Screen # 48

```
( ROMable Z-80 FORTH --- message (abort error number ?exec )
: MESSAGE       -DUP IF ." Message # " . ENDIF ;
: (ABORT)       ABORT ;
: ERROR         WARNING @ 0< IF (ABORT) ENDIF HERE COUNT TYPE
                ." ? " MESSAGE SP! BLK @ -DUP
                IF IN @ SWAP ENDIF QUIT ;
: ?ERROR        SWAP IF ERROR ELSE DROP ENDIF ;
: (NUMBER)      BEGIN 1+ DUP >R C@ BASE @ DIGIT WHILE SWAP
                BASE @ U* DROP ROT BASE @ U* D+ DPL @ 1+
                IF 1 DPL +! ENDIF R> REPEAT R> ;
: NUMBER        0 0 ROT DUP 1+ C@ 2D = DUP >R + -1 BEGIN DPL !
                (NUMBER) DUP C@ BL -
                WHILE DUP C@ 2E - 0 ?ERROR 0 REPEAT
                DROP R> IF DMINUS ENDIF ;
: ?EXEC         STATE @ 12 ?ERROR ;
:S
```

Screen # 49

```
( ROMable Z-80 FORTH ---  U< ?stack blanks word -find nfa etc.)
: U<            2DUP XOR 0< IF DROP 0< 0= ELSE - 0< ENDIF ;
: ?STACK        SP@ S0 @ SWAP U< 1 ?ERROR SP@ HERE
                80 + U< 7 ?ERROR ;
: BLANKS        BL FILL ;
: WORD          TIB @ IN @ + SWAP
                ENCLOSE HERE 22 BLANKS IN +! OVER - >R
                R HERE C! + HERE 1+ R> CMOVE ;
: -FIND         BL WORD HERE CONTEXT @ @ (FIND) DUP 0=
                IF DROP HERE LATEST (FIND) ENDIF ;
: NFA           5 - -1 TRAVERSE ;
: LFA           4 - ;
: ID.           PAD 20 5F FILL DUP PFA LFA OVER - PAD SWAP
                CMOVE PAD COUNT 1F AND TYPE SPACE ;
;S
```

Screen # 50

```
( ROMable Z-80 FORTH --- expect null min create interpret )
: EXPECT OVER + OVER DO KEY DUP 0E +ORIGIN @ = IF DROP DUP I =
  DUP R> 2 - + >R IF BELL ELSE BSOUT EMIT BL EMIT BSOUT
  ENDIF ELSE DUP 0D = IF LEAVE DROP
  BL 0 ELSE DUP ENDIF R C! 0 R 1+ ! ENDIF EMIT LOOP DROP ;
: X             R> DROP ; IMMEDIATE IS-X
: MIN           2DUP > IF SWAP ENDIF DROP ;
: CREATE -FIND IF DROP NFA ID. 4 MESSAGE SPACE ENDIF HERE
  DUP C@ WIDTH @ MIN 1+ ALLOT DUP A0 TOGGLE HERE 1 - 80
  TOGGLE LATEST , CURRENT @ ! HERE 2+ , ;
: INTERPRET BEGIN -FIND IF STATE @ < IF CFA , ELSE CFA EXECUTE
  ENDIF ?STACK ELSE HERE NUMBER DPL @ 1+ IF [COMPILE] DLITERAL
  ELSE DROP [COMPILE] LITERAL ENDIF ?STACK ENDIF AGAIN ;
;S
```

Screen # 51

```
( ROMable Z-80 FORTH --- query quit definitions decimal etc. )
: QUERY         TIB @ 50 EXPECT 0 IN ! ;
: [             0 STATE ! ; IMMEDIATE
: ]             C0 STATE ! ; IMMEDIATE
0 VARIABLE 'QMAIN  0 VARIABLE 'QPOST  ( vectors used in QUIT )
: NOOP ;
' NOOP  'QMAIN !   ' NOOP  'QPOST ! ( init to no action )
: QUIT          0 BLK ! [COMPILE] [ BEGIN  CR RP!
  'QMAIN @  CFA  EXECUTE  ( vectored part) QUERY INTERPRET
  STATE @ 0= IF ." ok" ENDIF  'QPOST @ CFA EXECUTE  AGAIN  ;
: DEFINITIONS   CONTEXT @ CURRENT ! ;
: DECIMAL       0A BASE ! ;
: (BUILDS       0 CONSTANT ;
: ABORT  SP! DECIMAL ?STACK  INIT-CICO INIT-DARTA INIT-APPLIC
  600BAUD       CR .CPU  ." fig-FORTH [LMI/OMT]  Post/1C.8" CR
                [COMPILE] FORTH DEFINITIONS QUIT ;
```

Screen # 52

```
( ROMable Z-80 FORTH --- erase ?pairs back begin endif etc. )
( *** WARNING:  BACK and ENDIF changed from fig-FORTH model )
HEX
: ERASE         0 FILL ;
: ?PAIRS        - 13 ?ERROR ;
: BACK          , ;
: BEGIN         ?COMP HERE 1 ; IMMEDIATE
: ENDIF         ?COMP 2 ?PAIRS HERE SWAP ! ; IMMEDIATE
: THEN          [COMPILE] ENDIF ; IMMEDIATE
: DO            COMPILE (DO) HERE 3 ; IMMEDIATE
```

Screen # 53

```
( ROMable Z-80 FORTH --- +loop until end again repeat if etc. )
: +LOOP         3 ?PAIRS COMPILE (+LOOP) BACK ; IMMEDIATE
: UNTIL         1 ?PAIRS COMPILE 0BRANCH BACK ; IMMEDIATE
: END           [COMPILE] UNTIL ; IMMEDIATE
: AGAIN         1 ?PAIRS COMPILE BRANCH BACK ; IMMEDIATE
: REPEAT        >R >R [COMPILE] AGAIN R> R> 2 -
                [COMPILE] ENDIF ; IMMEDIATE
: IF            COMPILE 0BRANCH HERE 0 , 2 ; IMMEDIATE
: ELSE          2 ?PAIRS COMPILE BRANCH HERE 0 , SWAP 2
                [COMPILE] ENDIF 2 ; IMMEDIATE
```

```
: LOOP          3 ?PAIRS COMPILE (LOOP) BACK ; IMMEDIATE
: COLD          INIT-RO RAM-START !
                INIT-RAM DUP >R 4 + RAM-START 2+ R> @ 2 - CMOVE
                12 +ORIGIN UP @ 6 + 10 CMOVE
                0C +ORIGIN @ ' FORTH 2+ @ 2+ !
                 ' MAIN  (  ' NOOP  )  'QMAIN !  ABORT ;
```

Screen # 54

```
( ROMable Z-80 FORTH --- .r hex immediate [compile] ' ." warm )
: .R            >R S->D R> D.R ;
: WARM          ABORT ;
: ."            22 STATE @ IF COMPILE (.") WORD HERE C@ 1+ ALLOT
                ELSE WORD HERE COUNT TYPE ENDIF ; IMMEDIATE
: HEX           10 BASE ! ;
: IMMEDIATE     LATEST 40 TOGGLE ;
: (             29 WORD ; IMMEDIATE
: [COMPILE]     -FIND 0= 0 ?ERROR DROP CFA , ; IMMEDIATE
: '             -FIND 0= 0 ?ERROR DROP
                [COMPILE]  LITERAL ; IMMEDIATE

20 CONSTANT BL
40 CONSTANT C/L
;S
```

Screen # 56

```
( OMT utilities: DUMP, PICK, ROLL, MSEC, >< )          DECIMAL
: DUMP ( adr --- dmp until key )
  8 / 8 *
  BEGIN  CR  DUP U.  8 0 DO  DUP I + C@  4 .R  LOOP  8 +
  ?TERMINAL UNTIL  DROP ;
: PICK  SP@  SWAP 2 *  +  @ ;
: ROLL  DUP >R  PICK  R>  0 SWAP
       DO  SP@  I DUP +  +  DUP 2 -  @  SWAP !
         -1 +LOOP  DROP ;
11 VARIABLE MSCNT
: MSEC ( n --- wait that many milliseconds )
  0 DO  MSCNT @ 0 DO LOOP  LOOP ;
CODE >< ( byteswap )
       HL POP          A, L LD    L, H LD    H, A LD
       HL PUSH         NEXT JP    END-CODE
```

Screen # 58

```
( OMT utilities: SCALL, decompiler H L S )             DECIMAL

CODE SCALL  ( ' NEXT  ' CODE-DEF --- does a CALL via the stack)
  RET  END-CODE          ( RET is the same as a call to TOS )
( WARNING: this is a machine CALL; used incautiously it will  )
(          crash Forth.  ' NEXT = 3F +-                       )

( simple decompiler: use ' NAME, then:                        )
: H  ( for word names )
  DUP U.  DUP 2+  SWAP @    2+  NFA ID. ;
: L  ( for LITs, BRANCHes )
  DUP U.  DUP 2+  SWAP @    DUP . U.  ;
: S  ( for strs,LIT"s)
  DUP U.  DUP  DUP C@ + 1+  SWAP  COUNT TYPE ;
```

```
: WHILE         [COMPILE] IF 2+ ; IMMEDIATE
: ?CSP          SP@ CSP @ - 14 ?ERROR ;
: ;             ?CSP COMPILE ;S SMUDGE [COMPILE] [ ; IMMEDIATE
;S
```

Screen # 55

```
( ROMable Z-80 FORTH --- mod ? forget vlist noop task )
: MOD           /MOD DROP ;
: C,            HERE C! 1 ALLOT ;
: ?             @ . ;
: FORGET        CURRENT @ CONTEXT @ - 18 ?ERROR [COMPILE] ' DUP
                FENCE @ < 15 ?ERROR DUP NFA DP !
                LFA @ CURRENT @ ! ;
: VLIST         C/L OUT ! CONTEXT @ @ BEGIN
                C/L OUT @ - OVER C@ 01F AND 4 + <
                IF CR 0 OUT ! ENDIF
                DUP ID. SPACE SPACE PFA LFA @ DUP 0=
                ?TERMINAL OR UNTIL DROP ;
;S
```

Screen # 57

```
( OMT utilities: DEPTH .S CS .US STKON STKOFF EXIT )   DECIMAL
: DEPTH  ( find depth of stack )
       S0 @  SP@ -  2 /  1 - ;
: .S  ( non-dest stk pr)
  DEPTH 0  DO  DEPTH  I -  PICK  .  LOOP ;
: CS  ( clr stk and pr)
  DEPTH 0  DO  DEPTH  ROLL .  LOOP ;
: .US  ( unsigned stack print )
  ."   " DEPTH -DUP
  IF  0 DO  DEPTH I -  PICK U.  LOOP  THEN ;

: STKON   ( enable stack print in QUIT )  ' .US  'QPOST ! ;
: STKOFF  ( disable  "    "   "  "   )  ' NOOP 'QPOST ! ;

: EXIT  R> DROP ;
;S
```

Screen # 59

```
( OMT utilities: CLS, XY )                             DECIMAL
0 VARIABLE CLS-VEC  ( contains 0 or ' clearscreen word )
0 VARIABLE XY-VEC   ( contains 0 or ' gotoxy word      )

: CLS ( vectored ) CLS-VEC @ DUP 0=
                IF  DROP  CR CR  EXIT  THEN  CFA EXECUTE ;
: XY ( vectored )  XY-VEC @  DUP 0=
                IF  DROP 2DROP  CR EXIT  THEN  CFA EXECUTE ;

: KPRO-XY    ( col row --- GOTOXY )  ( Kaypro/Qume )
  27 EMIT 61 EMIT  0 MAX 23 MIN  32 +  EMIT
                   0 MAX 79 MIN  32 +  EMIT ;

: MITE-CLS  ( cls through MITE on KPRO )  0 0 XY 23 EMIT ;
: QUME-CLS  ( Kaypro/Qume clearscreen  )  26 EMIT ;
```

Screen # 60

```
( CLS, XY, cont )                                   DECIMAL
: KPRO
  ' MITE-CLS CLS-VEC !  ' KPRO-XY XY-VEC ! ;
: QUME
  ' QUME-CLS CLS-VEC !  ' KPRO-XY XY-VEC ! ;

: IBM-CLS ( using ANSI.SYS: ESC [ 2 J )
  27 EMIT  91 EMIT  50 EMIT  74 EMIT ;
: IBM-XY  ( using ANSI.SYS: ESC [ row ; col H )
  27 EMIT  91 EMIT  .  59 EMIT  .  72 EMIT ;

: IBM
  ' IBM-CLS CLS-VEC !  ' IBM-XY XY-VEC ! ;
;S
```

Screen # 61

```
( MODE2, ENABLE/DISABLE-INT )  HEX

CODE MODE2      A, # BF LD
                FORTH 17ED , ASSEMBLER  ( bytes for LD I,A ;  )
                IM2  NEXT JP  END-CODE  ( no LD I,A in asm    )
( in case of emergency: type by hand:                         )
( CREATE MODE2 SMUDGE  BF3E , 17ED , 5EED , C300 , 003F )
( Note that 003F must be ' NEXT                               )
CODE DISABLE-INT    DI  NEXT JP  END-CODE
CODE ENABLE-INT     EI  NEXT JP  END-CODE

CODE 'NEXT ( --- adr of NEXT )
                  HL, # NEXT LD  HL PUSH  NEXT JP  END-CODE
CODE <RTI>        RETI  END-CODE
: RTI  ( push NEXT onto stack, then RETI; trick to clear INTs )
  'NEXT  <RTI> ;
```

Screen # 62

```
( Post: assignments for 7606 and RTI-1225 )          HEX
08 CONSTANT 7606-BASE                  ( 7606 port addresses )
7606-BASE     CONSTANT P1A  P1A 1+ CONSTANT P1A-CTL
7606-BASE 2 + CONSTANT P1B  P1B 1+ CONSTANT P1B-CTL
7606-BASE 4 + CONSTANT P2A  P2A 1+ CONSTANT P2A-CTL
7606-BASE 6 + CONSTANT P2B  P2B 1+ CONSTANT P2B-CTL
;S ****
0FFFE CONSTANT <D>A0>     ( RTI-1225 addresses, DAC0 and DAC1 )
0FFFF CONSTANT <D>A1>
DECIMAL
: D>AX ( raw D>A, +-127 )  <D>A0> C! ;
: D>AY ( raw D>A, +-127 )  <D>A1> C! ;

: XVX ( -100 to 100 )  100 MIN  -100 MAX  127 *  100 /  D>AX ;
: XVY ( -100 to 100 )  100 MIN  -100 MAX  127 *  100 /  D>AY ;
: HALT  0 XVX  XY-DELAY 2 MSEC  0 XVY ;
```

Screen # 63

```
( Post: misc variables: CTC2 )                        HEX
 0 VARIABLE CTC2-COUNT          ( BYTE CTC2 value )
 0 VARIABLE CTC2-OVER-FLAG      ( BYTE CTC2 overrun flag )
A7 VARIABLE CTC2-INIT-COMMAND   ( BYTE reload/restart command)
64 VARIABLE CTC2-INIT-COUNT     ( BYTE initial load value )

 8 VARIABLE MAIN-ENCODER-DIVISOR

 0 VARIABLE GLITCHES  ( count maintained by ISRs )
 0 VARIABLE STOP?     ( set by ISR1A, CHECK-STOP )
```

Screen # 64

```
( Post: misc variables: FLAGs and COUNTs )            DECIMAL
 0 VARIABLE A-FOLD-FLAG         ( BYTE count-to-fold flag )
 0 VARIABLE A-FOLD-COUNT        ( WORD counter-to-fold, in ISR)
 0 VARIABLE A-FOLD-COUNT-REF    ( WORD calc'd by main )
 0 VARIABLE A-RECOVER-FLAG      ( BYTE waiting-to-recover flag)
 0 VARIABLE A-RECOVER-COUNT     ( WORD counter-to-recover )

 0 VARIABLE B-FOLD-FLAG         ( BYTE count-to-fold flag )
 0 VARIABLE B-FOLD-COUNT        ( WORD counter-to-fold, in ISR)
 0 VARIABLE B-FOLD-COUNT-REF    ( WORD calc'd by main )
 0 VARIABLE B-RECOVER-FLAG      ( BYTE waiting-to-recover flag)
 0 VARIABLE B-RECOVER-COUNT     ( WORD counter-to-recover )

 6750 VARIABLE RECOVER-MILS-REF    ( WORD )
    0 VARIABLE RECOVER-COUNT-REF   ( WORD, mils )
 8000 VARIABLE PHOTOCELL-OFFSET    ( WORD, mils )
```

Screen # 65

```
( Post: ISR-7606-1A, trailing edge photocell )        HEX
CODE ISR-7606-1A ( handles port 1A, trailing edge photocell )
                 ( assumes active low signals )
  DI  AF PUSH  DE PUSH  HL PUSH        ( entry hskpg )
  A, P1A IN  E, A LD                   ( get port byte, save )
  A, P1A IN  A, E CP  NZ, GLITCH JP    ( ck again to deglitch)
  A, # 0FF LD  A-FOLD-FLAG , A LD      ( set fold flag on )
  HL, A-FOLD-COUNT-REF LD
  A-FOLD-COUNT , HL LD                 ( set count )
  EXIT-ISR JP                          ( done, std isr exit )
 HERE LABEL GLITCH                     ( handle glitches )
  HL, GLITCHES LD  HL INC
  GLITCHES , HL LD  EXIT-ISR JP
 HERE LABEL EXIT-ISR                   ( common ISR exit )
  HL POP  DE POP  AF POP  EI RETI
 END-CODE
```

Screen # 66

```
( Post: ISR-7606-2A, trailing edge photocell )        HEX
CODE ISR-7606-2A ( handles port 2A, trailing edge photocell )
                 ( assumes active low signals )
```

Screen # 67

```
( INIT-7606-1 )                                       HEX
: INIT-7606-1
  FF P1A-CTL P!        ( 1A )    ( set mode 3 of 7606        )
```

```
  DI  AF PUSH  DE PUSH  HL PUSH        ( entry hskpg )
  A, P2A IN  E, A LD                   ( get port byte, save )
  A, P2A IN  A, E CP  NZ, GLITCH JP    ( ck again to deglitch)
  A, # OFF LD  B-FOLD-FLAG , A LD      ( set fold flag on )
  HL, B-FOLD-COUNT-REF LD
  B-FOLD-COUNT , HL LD                 ( set count )
  EXIT-ISR JP                          ( done, std isr exit )
END-CODE
```

Screen # 68

```
( INIT-7606, -2 )                                  HEX
: INIT-7606-2
  FF P2A-CTL P!        ( 2A )   ( set mode 3 of 7606        )
  FF P2A-CTL P!                 ( all bits inputs            )
  0C P2A-CTL P!                 ( set int vector             )
  97 P2A-CTL P!                 ( act low, OR logic, enable  )
  FE P2A-CTL P!                 ( mask all but photocell     )
  FF P2B-CTL P!        ( 2B )   ( set mode 3 of 7606        )
  F0 P2B-CTL P!                 ( B7-4 in, B3-0 out          )
  0E P2B-CTL P!                 ( set int vector             )
  07 P2B-CTL P! ;               ( disable interrupts         )

: INIT-7606    INIT-7606-1  INIT-7606-2 ;
```

Screen # 69

```
( EN/DISABLE-7606 )                                HEX

: ENABLE-7606  ( only 1A and 2A generate interrupts )
  83 P1A-CTL P!  83 P2A-CTL P!  ;

: DISABLE-7606
  03 P1A-CTL P!  03 P1B-CTL P!  03 P2A-CTL P!  03 P2B-CTL P! ;
```

Screen # 70

```
( spare )
```

Screen # 71

```
( spare )
```

Screen # 72

```
( ISR-CTC1, main encoder pulses/n )
HEX
CODE ISR-CTC1
  DI  AF PUSH  DE PUSH  HL PUSH        ( housekeeping        )

  A, 0F2 IN  CTC2-COUNT , A LD         ( get current CTC2 cnt)
  A, A XOR  CTC2-OVER-FLAG , A LD      ( clear over-run flag )
  A, CTC2-INIT-COMMAND LD  0F2 , A OUT ( reset and           )
  A, CTC2-INIT-COUNT LD    0F2 , A OUT (        restart CTC2 )
```

Screen # 73

```
( ISR-CTC1, main encoder pulses/n, cont: A-FOLD )
( here label a-fold )
  A, A-FOLD-FLAG LD  A, A OR           ( skip if flag off    )
    Z, A-RECOVER JP
  HL, A-FOLD-COUNT LD  HL DEC          ( dec and save count  )
    A-FOLD-COUNT , HL LD
  A, H LD  A, L OR  NZ, A-RECOVER JP   ( skip if not zero    )
  A, # FE LD  P1B , A OUT              ( fire FOLD           )
  A, A XOR  A-FOLD-FLAG , A LD         ( clear FOLD flag     )
  A, # FF LD  A-RECOVER-FLAG , A LD    ( set RECOVER flag    )
  HL, RECOVER-COUNT-REF LD             ( set RECOVER count   )
    A-RECOVER-COUNT , HL LD
```

Screen # 74

```
( ISR-CTC1, main encoder pulses/n, cont: A-RECOVER )
 HERE LABEL A-RECOVER
  A, A-RECOVER-FLAG  LD  A, A OR  Z, B-FOLD JP ( JP if fl off)
  HL, A-RECOVER-COUNT LD  HL DEC       ( decr RECOVER count  )
    A-RECOVER-COUNT , HL LD
  A, H LD  A, L OR  NZ, B-FOLD JP      ( skip if count not 0 )
  A, # FD LD  P1B , A OUT              ( fire RECOVER        )
  A, A XOR  A-RECOVER-FLAG , A LD      ( clear RECOVER flag  )
```

Screen # 75

```
( ISR-CTC1, main encoder pulses/n, cont: B-FOLD )
 HERE LABEL B-FOLD
  A, B-FOLD-FLAG LD  A, A OR           ( skip if flag off    )
    Z, B-RECOVER JP
  HL, B-FOLD-COUNT LD  HL DEC          ( dec and save count  )
    B-FOLD-COUNT , HL LD
  A, H LD  A, L OR  NZ, B-RECOVER JP   ( skip if not zero    )
  A, # FE LD  P2B , A OUT              ( fire FOLD           )
  A, A XOR  B-FOLD-FLAG , A LD         ( clear FOLD flag     )
  A, # FF LD  B-RECOVER-FLAG , A LD    ( set RECOVER flag    )
  HL, RECOVER-COUNT-REF LD             ( set RECOVER count   )
    B-RECOVER-COUNT , HL LD
```

Screen # 76

```
( ISR-CTC1, main encoder pulses/n, cont: B-RECOVER )
 HERE LABEL B-RECOVER
  A, B-RECOVER-FLAG  LD  A, A OR  Z, EXIT-ISR JP ( JP if off )
  HL, B-RECOVER-COUNT LD  HL DEC       ( decr RECOVER count  )
```

Screen # 77

```
( ISR-CTC2 )                                       HEX
CODE ISR-CTC2 ( set CTC2-OVER-FLAG if CTC2 gets to zero )
  DI  AF PUSH  DE PUSH  HL PUSH        ( housekeeping )
  A, # OFF LD                          ( set flag on )
```

```
    B-RECOVER-COUNT , HL LD
  A, H LD  A, L OR  NZ, EXIT-ISR JP   ( skip if count not 0 )
  A, # F0 LD  P2B , A OUT             ( fire RECOVER        )
  A, A XOR  B-RECOVER-FLAG , A LD     ( clear RECOVER flag  )
  EXIT-ISR JP                         ( DONE!               )
END-CODE
```

Screen # 78

```
( INIT-CTC-ISV/1/2 )                                  HEX

: INIT-CTC-ISV ( load CTC w/ vector )
  10 F0 P! ;

: INIT-CTC1 ( to count main encoder pulses/n )
  C7 F1 P! ( int on, counter, falling edges, load next byte )
  MAIN-ENCODER-DIVISOR C@  F1 P! ;

: INIT-CTC2 ( to be a down-count clock )
  CTC2-INIT-COMMAND C@  F2 P! ( int on,timer,/256,st/ld,nxt )
  CTC2-INIT-COUNT C@  F2 P! ; ( initially 100 decimal )
```

Screen # 80

```
( BLINK, RPT-BLINK )                                  HEX
: BLINK ( walk the ZT-7502 lights )
  1  8 0 DO  DUP 40 P!  2 *  1000 MSEC  LOOP  DROP ;

: RPT-BLINK
  BEGIN  BLINK  ?TERMINAL UNTIL ;

;S
```

Screen # 82

```
( OFFSET-TABLE, OC@/!, INIT-OFFSET-TABLE,SPEED-OFFSET ) DECIMAL
0 VARIABLE OFFSET-TABLE  20 ALLOT-RAM
: OC@ ( i --- offset )          OFFSET-TABLE +  C@ ;
: OC! ( n i --- )               OFFSET-TABLE +  C! ;
: INIT-OFFSET-TABLE
  20 0 DO  100 I OC!  LOOP     ( clear table to high values )
  39 00 OC!  87 05 OC!  91 10 OC!  93 15 OC!
  69 01 OC!  88 06 OC!  91 11 OC!  93 16 OC!
  74 02 OC!  89 07 OC!  92 12 OC!  94 17 OC!
  79 03 OC!  90 08 OC!  92 13 OC!  94 18 OC!
  81 04 OC!  90 09 OC!  93 14 OC!  95 19 OC! ;
0 VARIABLE CTEMP
: SPEED-OFFSET ( --- mils )
  CTC2-OVER-FLAG @  CTC2-COUNT @ CTEMP !  IF  1  EXIT  THEN
  0  20 0 DO    I OC@  CTEMP @ (
             IF  DROP  I  THEN  LOOP    100 * ;
```

Screen # 84

```
( .INFO )
DECIMAL
0 VARIABLE '.INFO  ' NOOP '.INFO !
: .INFO ( vectored display within MAIN loop )
  '.INFO @  CFA  EXECUTE ;
```

```
  CTC2-OVER-FLAG , A LD
  EXIT-ISR JP                         ( std ISR exit )
END-CODE
```

Screen # 79

```
( INIT-ISV )
HEX

: INIT-ISV
      ' ISR-7606-1A  BF08 !    ' ISR-7606-2A  BF0C !
      ' ISR-CTC1     BF12 !    ' ISR-CTC2     BF14 ! ;

( BF08  7606-1A        BF10  CTC0 )
(  0A      -1A          12     1 )
(  0C      -2A          14     2 )
(  0E      -2B          16     3 )
```

Screen # 81

```
( A/B-FLAP-SW>MILS )                                  DECIMAL

: A-FLAP-SW>MILS ( --- n, flap length in mils )
  P1B P@  240 AND  16 /  9 MIN  1000 *        ( inches>mils )
  P1A P@  240 AND  16 /  9 MIN   100 *  +     ( + .1">mils  )
  P1A P@   14 AND   2 /  9 MIN    20 *  + ;   ( + .02">mils )

: B-FLAP-SW>MILS ( --- n, flap length in mils )
  P2B P@  240 AND  16 /  9 MIN  1000 *        ( inches>mils )
  P2A P@  240 AND  16 /  9 MIN   100 *  +     ( + .1">mils  )
  P2A P@   14 AND   2 /  9 MIN    20 *  + ;   ( + .02">mils )
```

Screen # 83

```
( INIT-APPLIC )                                       DECIMAL

: INIT-APPLIC ( application-specific initializations )
      DISABLE-INT  MODE2
      INIT-ISV
      INIT-CTC-ISV
      INIT-CTC2
      INIT-CTC1  INIT-OFFSET-TABLE
      INIT-7606  ENABLE-INT ;
```

Screen # 85

```
( MILS>COUNTS, SET-A/B/RECOVER-OFFSET                 11/8/85 )
DECIMAL

: MILS>COUNTS ( mils --- counts for FOLD and RECOVER counters )
  5 /                        ( 200 counts/in = 5 mils/count)
  MAIN-ENCODER-DIVISOR @  / ;  ( only count every M-E-D pulse)
```

```
: .INFO-DEF    0 3 KY
   ." A"  A-FLAP-SW>MILS  5 .R
   ." B"  B-FLAP-SW>MILS  5 .R
   ." S"  SPEED-OFFSET    5 .R
   ."  DC:"  CTC2-OVER-FLAG C@
  IF    ." too slow"
  ELSE  CTC2-COUNT @  4 .R THEN ;

' .INFO-DEF  '.INFO !
```

```
: SET-A-FOLD-OFFSET ( # counts from photocell to fold cmd )
  PHOTOCELL-OFFSET @  A-FLAP-SW>MILS -  SPEED-OFFSET -
  MILS>COUNTS  A-FOLD-COUNT-REF ! ;
: SET-B-FOLD-OFFSET ( # counts from photocell to fold cmd )
  PHOTOCELL-OFFSET @  B-FLAP-SW>MILS -  SPEED-OFFSET -
  MILS>COUNTS  B-FOLD-COUNT-REF ! ;
: SET-RECOVER-OFFSET ( # counts from fold cmd to recover cmd )
  RECOVER-MILS-REF @  MILS>COUNTS  RECOVER-COUNT-REF ! ;
```

Screen # 86

```
( MAIN )
DECIMAL
: MAIN
  CR  ." Press ESC to stop, but only when f/g is stopped." CR
  SET-RECOVER-OFFSET
  BEGIN  .INFO                ( Note: the "real work" of mon- )
      SET-A-FOLD-OFFSET       ( itoring counts, firing FOLD,  )
      SET-B-FOLD-OFFSET       ( etc., is handled in ISRs.     )
  ?TERMINAL
  IF  KEY  DUP 26 = IF  ' NOOP 'QMAIN !  QUIT  THEN  ( ctl-Z )
             27 = IF  CTC2-OVER-FLAG C@  ELSE  0  THEN
  ELSE  0  THEN
  UNTIL  CR CR ." Type MAIN to restart." CR CR
 ' NOOP 'QMAIN !  QUIT ;
( ' MAIN  'QMAIN ! )  ( see also COLD )
```

Screen # 87

```
( PTEST, 600BAUD, 9600BAUD )
DECIMAL
: PTEST ( display 4 7606 ports on key until CR )
  BEGIN  CR
      8 P@ 4 .R  10 P@ 4 .R  12 P@ 6 .R  14 P@ 4 .R
  KEY 13 = UNTIL ;

HEX
: 600BAUD
  45 F0 P!  D0 F0 P! ;        ( 7806-0, 600 baud, 4.00 MHz )
: 9600BAUD
  45 F0 P!  00 F0 P! ;        ( 7806-0, 9600 baud, 4.00 MHz)

DECIMAL
```

Screen # 88

```
( PTEST, 600BAUD, 9600BAUD )
DECIMAL
: PTEST ( display 4 7606 ports on key until CR )
  BEGIN  CR
      8 P@ 4 .R  10 P@ 4 .R  12 P@ 6 .R  14 P@ 4 .R
  KEY 13 = UNTIL ;

HEX
: 600BAUD
  45 F0 P!  D0 F0 P! ;        ( 7806-0, 600 baud, 4.00 MHz )
: 9600BAUD
  45 F0 P!  00 F0 P! ;        ( 7806-0, 9600 baud, 4.00 MHz)

DECIMAL
```

Screen # 89

What is claimed is:

1. A trailing panel folding system for use in a blank folding machine including coveyor means driven by a drive means for continuously advancing blanks with trailing panels in a predetermined direction in untimed relationship to one another along a generally horizontal path, said trailing panel folding system comprising:

a rotatable shaft mounted below said path and transverse thereto;

a motor, which is not part of said drive means, connected to drive said shaft;

arm means mounted on said shaft and extending generally radially therefrom, said arm means having at least one arm extending away from said shaft and a folding head for folding a trailing panel of a blank at the distal end of said arm and projecting therefrom substantially normal to the axis of said shaft;

an encoder interconnected with said drive means providing a pulsed output related to the velocity at which said blanks are moving along said path;

a blank sensor responsive to the presence of a blank at a predetermined location along said path upstream of said shaft for providing a trailing edge signal when the trailing edge of the sensed blank leaves said location;

a programmable motor controller for operating said motor through a cycle of operation, said controller including means for moving said arm means to a predetermined start position wherein said folding head is disposed upstream of said shaft, means for causing said folding head to move to an up position wherein said folding head overlies the folded trailing panel at a speed sufficiently fast to overtake and fold the panel, means to cause said folding head to dwell in said up position, and means for causing said arm means to move to a start position after the folded panel has moved from under said folding head; and a microprocessor interconnected with said encoder, said blank sensor and said controller for receiving input signals based upon the operation of said sensor and said encoder, and providing output signals to said controller to start said cycle and to cause said head to move from said up position, wherein said means for causing said folding head to move to an up position causes said motor to operate in accordance with a first acceleration/velocity profile, and wherein said means for causing said arm means to move to a start position causes said motor to operate in accordance with a second acceleration/velocity profile, said first and second profiles being different.

2. A system as set forth in claim 1 wherein said motor is a brushless synchronous motor.

3. A system as set forth in claim 1 further comprising memory means associated with said microprocessor, said memory means having a look up table containing information regarding delay time to provide its output signal to said controller after said sensor provides its signal.

4. A system as set forth in claim 1 further comprising an operator settable carton depth switch for providing binary coded decimal information regarding the length of the blank to said microprocessor.

5. A system as set forth in claim 1 further comprising signal conditioning circuitry interconnecting said microprocessor with said encoder and said sensor for converting the outputs of the encoder and sensor into sharply defined square waves.

6. A system as set forth in claim 1 wherein said arm means comprises a pair of arms with a folding head carried by each arm, the leading ends of said folding heads being spaced by substantially 180 degrees with respect to the axis of said shaft.

7. A system as set forth in claim 1 wherein each blank has a pair of outer trailing panels flanking an inner trailing panel, said motor, shaft and arm means being first such components for folding said outer panels, said system further including a second motor driving a second shaft mounting a second arm means for folding said inner trailing panel.

8. A system as set forth in claim 1 further including a resolver in operative relationship with said shaft for providing a feedback signal to said controller indicating substantially the exact position of said shaft.

9. A trailing panel folding system for use in a blank folding machine including conveyor means for continuously advancing blanks with trailing panels in a predetermined direction in untimed relationship to one another along a generally horizontal path, said trailing panel folding system comprising:

a rotatable shaft mounted below said path and transverse thereto;

a brushless servomotor, which is not part of said drive means, connected to drive said shaft;

arm means mounted on said shaft and extending generally radially therefrom, said arm means having at least one arm extending away from said shaft and a folding head for folding a trailing panel of a blank at the distal end of said arm and projecting therefrom substantially normal to the axis of said shaft;

an encoder interconnected with said drive means providing a pulsed output related to the velocity at which said blanks are moving along said path;

a blank sensor responsive to the presence of a blank at a predetermined location along said path upstream of said shaft for providing a trailing edge signal when the trailing edge of the sensed blank leaves said location;

a programmable motor controller for operating said servomotor through a cycle of operation; and a microprocessor interconnected with said encoder, said blank sensor and said controller for receiving input signals based upon the operation of said sensor and said encoder, and providing an output signal to said controller to start said cycle, wherein said controller comprises means for moving said arm means to a predetermined start position wherein said folding head is disposed upstream of said shaft, means for causing said folding head to move to an up position wherein said folding head overlies the folded trailing panel at a speed sufficiently fast to overtake and fold the panel using a first acceleration/velocity profile, means to cause said folding head to dwell in said up position, and means for causing said arm means to move to a start position after the folded panel has moved from under said folding head using a second acceleration/velocity profile which causes said shaft to rotate at a faster angular velocity than using said first profile.

10. A system as set forth in claim 9 wherein said microprocessor comprises means for providing an output signal to said controller to cause said head to move from said up position.

11. A method of folding trailing panels of carton blanks conveyed in a predetermined direction in untimed relationship to one another along a generally horizontal path by means of a folder head adapted to fold a trailing panel mounted on a rotatable shaft driven by a motor, said shaft being positioned below said path and transverse thereto, said method comprising the following steps:

positioning the folding head so that it is in a start position in which it is below said path;

detecting the passage of a carton blank upstream of said shaft;

upon the expiration of a delay period after the detection, accelerating said folder head to a first maximum angular velocity to move said folding head toward an up position overlying a trailing panel resulting in the trailing panel being folded;

maintaining said folding head in said up position until the folded panel is advanced from under the head; and returning said head to a start position in which said head is disposed below said path by acceleration of said head to a maximum angular velocity greater than the aforementioned velocity.

* * * * *